US010975690B2

(12) United States Patent
Guijt et al.

(10) Patent No.: US 10,975,690 B2
(45) **Date of Patent: *Apr. 13, 2021**

(54) DISTRIBUTED REMOTE LOGGING

(71) Applicant: Baker Hughes, a GE company, LLC, Houston, TX (US)

(72) Inventors: Peter J. Guijt, Houston, TX (US); Nigel N. Smith, Houston, TX (US); Douglas C. Young, Houston, TX (US); Harold Andrade, The Woodlands, TX (US); Homero C. Castillo, Kingwood, TX (US)

(73) Assignee: BAKER HUGHES HOLDINGS LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/154,453

(22) Filed: Oct. 8, 2018

(65) Prior Publication Data

US 2019/0048715 A1 Feb. 14, 2019

Related U.S. Application Data

(63) Continuation of application No. 15/600,035, filed on May 19, 2017, now Pat. No. 10,094,213.

(51) Int. Cl.

| | |
|---|---|
| ***E21B 47/26*** | (2012.01) |
| ***E21B 47/00*** | (2012.01) |
| ***E21B 47/12*** | (2012.01) |

(52) U.S. Cl.

CPC ..... *E21B 47/26* (2020.05); *E21B 47/00* (2013.01); *E21B 47/12* (2013.01)

(58) Field of Classification Search

CPC ..... E21B 33/062; E21B 33/055; E21B 47/124

(Continued)

(56) References Cited

U.S. PATENT DOCUMENTS 4,490,788 A * 12/1984 Rasmussen ..... E21B 47/00 710/21

5,689,641 A 11/1997 Ludwig et al.

(Continued)

FOREIGN PATENT DOCUMENTS

WO 0225319 A2 3/2002
WO 2014078836 A1 5/2014

OTHER PUBLICATIONS

PCT/US2018/033483 ISR and Written Opinion, dated Nov. 15, 2018.

*Primary Examiner* — Omar Casillashernandez
(74) *Attorney, Agent, or Firm* — Mossman Kumar & Tyler PC

(57) ABSTRACT

Methods, systems, and apparatuses for remote well logging. Methods include conducting, with a plurality of remote well operation control hosts operating on corresponding remote well logging data acquisition management systems, a well logging operation using a well logging system at a logging site, wherein the well logging system includes a conveyance device having disposed thereon a first logging instrument and a second logging instrument; operating the first logging instrument responsive to at least one well-logging command from a first remote well operation control host of the plurality; and operating the second logging instrument responsive to at least one well-logging command from a second remote well operation control host of the plurality different than the first. Methods include transmitting a virtual presence feed associated with a logging site supervisor from the logging site to at least one of the corresponding remote well logging data acquisition management systems.

13 Claims, 12 Drawing Sheets

(58) Field of Classification Search
USPC ..... 340/850, 851
See application file for complete search history.

(56) References Cited

U.S. PATENT DOCUMENTS 5,959,547 A 9/1999 Tubel et al.
6,046,685 A 4/2000 Tubel
6,139,197 A 10/2000 Banks
6,223,206 B1 4/2001 Dan et al.
6,516,898 B1 * 2/2003 Krueger ..... E21B 4/18 175/50
6,801,949 B1 * 10/2004 Bruck ..... H04L 29/12009 709/232
6,842,768 B1 1/2005 Shaffer et al.
6,896,056 B2 5/2005 Mendez et al.
6,980,929 B2 12/2005 Aronstam et al.
7,228,903 B2 6/2007 Wang et al.
7,295,926 B2 * 11/2007 Jeffryes ..... G01V 11/00 340/854.1
7,305,305 B2 12/2007 Beeson
7,403,000 B2 7/2008 Barolak et al.
7,525,872 B2 4/2009 Tang et al.
7,672,262 B2 3/2010 McCoy et al.
7,787,327 B2 8/2010 Tang et al.
7,795,864 B2 9/2010 Barolak et al.
8,055,448 B2 11/2011 Mathiszik et al.
8,061,206 B2 11/2011 Bolshakov et al.
8,788,207 B2 7/2014 Pei et al.
8,811,114 B2 8/2014 Geerits et al.
9,103,196 B2 8/2015 Zhao et al.
9,569,097 B2 2/2017 Ramachandran et al.
9,581,720 B2 2/2017 Dorovsky et al.
2002/0171560 A1 * 11/2002 Ciglenec ..... E21B 7/061 340/853.1
2004/0134667 A1 * 7/2004 Brewer ..... E21B 17/023 166/380
2007/0237402 A1 10/2007 Dekel et al.
2010/0147510 A1 6/2010 Kwok et al.
2012/0026002 A1 * 2/2012 Vu ..... E21B 47/00 340/854.6
2013/0173505 A1 * 7/2013 Balogun ..... E21B 43/121 706/12
2014/0019049 A1 1/2014 Dorovsky et al.
2014/0158350 A1 * 6/2014 Castillo ..... E21B 23/10 166/250.17
2015/0226049 A1 * 8/2015 Frangos ..... E21B 44/00 702/6
2016/0084029 A1 * 3/2016 Castillo ..... E21B 31/00 166/297
2016/0084076 A1 * 3/2016 Fanini ..... E21B 47/12 340/853.1
2016/0186552 A1 * 6/2016 Penn ..... E21B 7/04 700/275
2017/0102479 A1 4/2017 Kouchmeshky et al.

* cited by examiner

DISTRIBUTED REMOTE LOGGING

CROSS REFERENCE TO RELATED APPLICATIONS

This application claims priority from U.S. application Ser. No. 15/600,035 filed May 19, 2017, the entire disclosure of which is incorporated herein by reference in its entirety.

FIELD OF THE DISCLOSURE

This disclosure generally relates to borehole tools, and in particular to methods and apparatuses for conducting well logging.

BACKGROUND OF THE DISCLOSURE

Drilling wells for various purposes is well-known. Such wells may be drilled for geothermal purposes, to produce hydrocarbons (e.g., oil and gas), to produce water, and so on. Well depth may range from a few thousand feet to 25,000 feet or more.

In conventional oil well logging, during well drilling and/or after a well has been drilled, instruments may be conveyed into the borehole and used to determine one or more parameters of interest related to the formation. A rigid or non-rigid conveyance device is often used to convey the instruments, often as part of a tool or a set of tools, and the conveyance device may also provide communication channels for sending information up to the surface.

During or after drilling, these instruments in the wellbore are used to carry out any number of subterranean investigations of the earth formation or of infrastructure associated with the wellbore. Several instruments may be housed in a single tool, multiple tools may be connected on a single conveyance device, or both. Thus, the tools may include variety of sensors and/or electronics for formation evaluation, monitoring and controlling the instruments, monitoring and controlling the conveyance device, and so on. Aspects of control of these instruments to conduct investigations are carried out by electronics downhole and by control equipment and/or personnel at the well surface, which may be connected by a local area network ('LAN'). Optionally, remotely located control equipment and/or personnel may send commands to logging instruments, e.g., over a wide-area network ('WAN').

A LAN is a computer network that spans a relatively small area. Many LANs are confined to a single building or group of buildings, or a single well site. However, one LAN can be connected to other LANs over any distance (e.g., via telephone lines, fiber networks, radio waves, etc.). A wide-area network ('WAN') is a system of LANs connected in this way. The Internet is an example of a WAN.

SUMMARY OF THE DISCLOSURE

In aspects, the present disclosure is related to methods, systems, and apparatuses for remote well logging. Methods include conducting, with a plurality of remote well operation control hosts operating on corresponding remote well logging data acquisition management systems, a well logging operation using a well logging system at a logging site, wherein the well logging system includes a conveyance device having disposed thereon a first logging instrument and a second logging instrument; operating the first logging instrument responsive to at least one well-logging command from a first remote well operation control host of the plurality; and operating the second logging instrument responsive to at least one well-logging command from a second remote well operation control host of the plurality different than the first.

The conveyance device, or carrier, may include at least one of i) a drill string; and ii) a wireline. Where the carrier comprises a drill string, the logging tool may include a bottom hole assembly (BHA). Methods may include performing drilling operations by rotating a drill bit disposed at a distal end of the drill string and taking well logging measurements to generate raw well logging data during drilling operations.

Methods may include acquiring raw well logging data from the first logging instrument and the second logging instrument by a local well operation control host on a corresponding well logging data acquisition management system at the logging site; mirroring the acquired raw well logging data to at least one of the plurality of remote well operation control hosts; and issuing a further command from at least one of the plurality of remote well operation control hosts responsive to the acquired raw well logging data.

Methods may include identically processing the logging data at the local well operation control host in parallel with processing the logging data at the plurality of remote well operation control hosts. Methods may include, during a logging operation, using a Wide Area Network (WAN) to transmit substantially all raw well logging data generated by the first logging instrument and the second logging instrument from the logging site to at least one of the plurality of remote well operation control hosts; and using the logging data to control the logging operation with at least one second command in substantially real-time from the at least one of the plurality of remote well operation control hosts responsive to the logging data received.

Methods may include determining a value for at least one data transfer characteristic (e.g. average throughput, downtime, or failure in a given period) of the WAN with respect to the at least one of the plurality of remote well operation control hosts; making a comparison of the value for the at least one data transfer characteristic with at least one operational sufficiency profile, the at least one operational sufficiency profile representative of data transfer characteristic values indicating data transfer sufficient for control of the logging operation in substantially real-time; and implementing a contingent operational mode in dependence upon the comparison. The implemented contingent operational mode may be selected from a plurality of available contingent operational modes in dependence upon an order of priority of at least one of: i) logging data from the first logging instrument; ii) logging data from the second logging instrument. The implemented contingent operational mode may be selected from a plurality of available contingent operational modes in dependence upon an order of priority of operations between a first logging operation associated with the first logging instrument and second logging operation associated with the first logging instrument.

Methods may include synchronizing the plurality of remote well operation control hosts with the local well operation control host. The well operation control host may be remote from the logging site. Methods may include conveying the conveyance device to intersect a volume of interest relating to the first logging instrument via tool commands from a first of the plurality of remote well operation control hosts; and assigning control of the conveyance device, upon the device intersecting the volume of interest, from the first of the plurality of remote well operation control hosts to a second of the plurality of remote well operation control hosts.

Methods may include, during a logging operation, using a Wide Area Network (WAN) to transmit a virtual presence feed associated with a logging site supervisor from the logging site to at least one of the corresponding remote well logging data acquisition management systems; and using the virtual presence feed to construct a representation of a virtual presence perspective of the position of the logging site supervisor at the logging site, and presenting the representation to a remote well operating engineer at the at least one of the corresponding remote well logging data acquisition management systems. The virtual presence feed may include information representing video, audio, location data (e.g., GPS data), and so on. Methods may include, during the logging operation, using a Wide Area Network (WAN) to transmit audio instruction data and auxiliary data from the at least one of the corresponding remote well logging data acquisition management systems to the logging site; rendering the audio instruction data as audio instructions via a personal communication system of the logging site supervisor; and rendering the auxiliary data on a graphic interface of the personal communication system of the logging site supervisor.

The well logging operation may include at least one of: i) geosteering; ii) drilling at least one borehole in a formation; iii) performing measurements on a formation; iv) estimating parameters of a formation; v) installing equipment in a borehole; vi) evaluating a formation; vii) optimizing present or future development in a formation or in a similar formation; viii) optimizing present or future exploration in a formation or in a similar formation; ix) producing one or more hydrocarbons from a formation; x) performing maritime logging operations of a seabed.

Methods may include conducting, with the plurality of remote well operation control hosts operating on the corresponding remote well logging data acquisition management systems, a second well logging operation using a second well logging system at a second logging site remote from the first logging site, wherein the second well logging system includes a second conveyance device having disposed thereon a third logging instrument and a fourth logging instrument, comprising: operating the third logging instrument responsive to at least one well-logging command from the first remote well operation control host of the plurality; and operating the fourth logging instrument responsive to at least one well-logging command from the second remote well operation control host. Methods may include comprising enabling i) operation of the first logging instrument by the first remote well operation control host, ii) operation of the second logging instrument by the second remote well operation control host, iii) operation of the third logging instrument by the first remote well operation control host, and iv) operation of the fourth logging instrument by the second remote well operation control host by using a master remote well operation control host, of the plurality of remote well operation control hosts, on a corresponding remote well logging data acquisition management system to distribute control capability for a particular instrument to a particular remote well operation control host.

Methods may include enabling operation of the first logging instrument by the first remote well operation control host and operation of the second logging instrument by the second remote well operation control host by using a master remote well operation control host, of the plurality of remote well operation control hosts, on a corresponding remote well logging data acquisition management system to distribute control capability for a particular instrument to a particular remote well operation control host.

Methods may include distributing control capability in dependence upon an operational mode. All the acquired well logging data may pass through the corresponding remote well logging data acquisition management system of the master remote well operation control host. Methods may include controlling the conveyance device using at least one well operation control host of the plurality. Methods may include enabling operation of the first logging instrument by the first remote well operation control host and operation of the second logging instrument by the second remote well operation control host by using a distributed remote cluster to provide logging data related to the first logging instrument and the second logging instrument to the first remote well operation control host and the second remote well operation control host.

Methods as described above implicitly utilize at least one processor. Some embodiments include a non-transitory computer-readable medium product accessible to the processor and having instructions thereon that, when executed, causes the at least one processor to perform methods described above. Apparatus embodiments may include, in addition to specialized borehole measurement equipment and conveyance apparatus, at least one processor and a computer memory accessible to the at least one processor comprising a computer-readable medium having instructions thereon that, when executed, causes the at least one processor to perform methods described above.

Examples of some features of the disclosure may be summarized rather broadly herein in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Figure 1A:
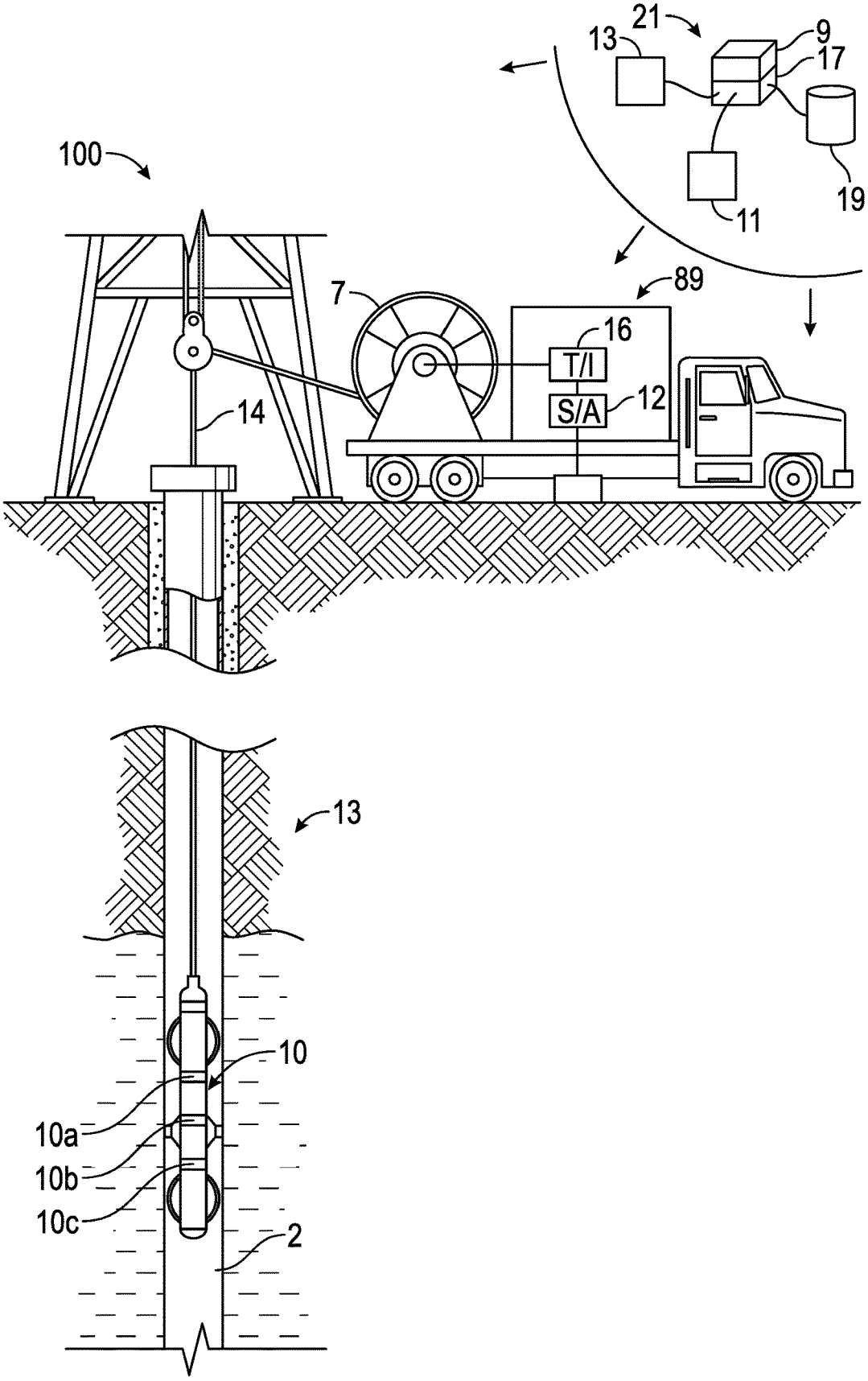
FIG. 1A is a schematic diagram of an example well logging system in accordance with embodiments of the present disclosure.

Aspects of the present disclosure relate to apparatus and methods for well logging, including measurement and interpretation of physical phenomena indicative of parameters of interest of the formation, the borehole, infrastructure installed in the formation (e.g., casing), downhole fluids in one of these, or combinations of the same. Techniques described herein are particularly suited to cooperative multi-instrument subterranean investigation. Further aspects include improved control structures for subterranean investigation.

In conventional oil well logging, during well drilling and/or after a well has been drilled, instruments conveyed in the wellbore are used in order to carry out any number of subterranean investigations of the earth formation, the borehole, fluid in the formation or borehole, or of infrastructure associated with the wellbore, all of which may be referred to as well logging. Aspects of control of these instruments to conduct investigations are carried out by electronics downhole and by control equipment and/or personnel at the well surface.

In the current standard mode of operation in the wireline logging industry, all downhole measuring equipment is controlled and sensor data is recorded by local data acquisition systems. The local data acquisition system may in some cases be controlled by a remote computer system interface (e.g., using keyboard, mouse, and monitor) over a network connection.

Traditionally, of those personnel at the well site, a well operator is the chief individual responsible for the success of the logging operation. Although rewarding, a career as a well operator may be quite demanding. The well operator (or 'well operations engineer') must be familiar with the functioning of all the instruments conveyed in the borehole, and must understand and communicate job objectives, priorities, and deliverables to other personnel. The well operator must also verify functionality of all the instruments and supporting infrastructure, such as, for example, communications and conveyance devices. Perhaps most importantly, because logging typically requires conveyance of a carrier in the borehole (e.g., a logging run, or trip), the well operator must also be onsite to manage acquisition of well-logging data via operations of the instruments in conjunction with the greater tool system. All logging tools are affected by environmental conditions. Thus, mitigation of environmental effects with real-time corrections to instruments, conveyance devices, and infrastructure is critical to the production of accurate well logging data.

During data acquisition, the well operator leverages his or her expertise to control the logging instruments downhole in substantially real time. The well operator has a myriad of options available on a minute-by-minute basis to change tool parameters and techniques to optimize well logging results. Traditionally, well operators at a well site have full access to unmitigated raw data communicated uphole from the instruments, although conventionally this is not possible for operators using remote control. In operating each instrument, access to substantially all the raw data has proven critical in optimizing the measurement results from each instrument via real-time adjustments to measurement processes.

However, as the number and variety of well instruments has proliferated and the capabilities of (and the logging processes available from) each instrument have expanded, demands on operational personnel have exceeded the capabilities of a single well operator, particularly in light of required travel. A limited number of personnel with the right combination of expertise for a particular job may be required at the same time at wells scattered across the globe.

Aspects of the present disclosure include methods and systems for distributed remote logging. A separate remote subject matter expert may individually control each particular downhole instrument, tool, or process responsive to substantially all available logging data. Each of these experts may interact with a different well operation control host running on a separate data acquisition management system at different locations, and each system may be tailored to the logging operations under its control.

All downhole measuring equipment and sensor data may be controlled and transmitted by a local data acquisition management system. This local data acquisition management system may be controlled through a network by one or more remote data acquisition management systems, each of which may include data acquisition control, recording and processing system(s).

The raw logging data from the instruments is communicated in full to a local system (that is, at the well site) for storage and management. Substantially all of the raw logging data is also mirrored to the remote system(s) over a network to ensure continuous operation with no data loss under communication interruptions or equipment malfunctions. In some implementations, the local system may connect to a remote data acquisition management system over a network connection, and from there connect to multiple remote computer systems, in order to reduce the load on the network connection between the local and remote systems.

Methods of remote well logging as disclosed herein may include conducting, with a plurality of remote well operation control hosts operating on corresponding remote well logging data acquisition management systems, a well logging operation using a well logging system at a logging site, wherein the well logging system includes a conveyance device having disposed thereon a first logging instrument and a second logging instrument; operating the first logging instrument responsive to at least one well-logging command from a first remote well operation control host of the plurality; and operating the second logging instrument responsive to at least one well-logging command from a second remote well operation control host of the plurality different than the first. The conveyance device may include a tool, tool string, drill string, or the larger tool delivery system.

Aspects of the present disclosure include systems, devices, products, and methods of well logging using logging instruments in a borehole in an earth formation. Methods may include conveying multiple logging instruments in the borehole on at least one conveyance device ('carrier'); taking well logging measurements with the logging instruments, and estimating a property of a subterranean volume of interest.

Aspects of the present disclosure relate to using at least one sensor as part of one or more downhole well logging instruments to produce information responsive to physical phenomena in the earth formation ('logging information'). The information is indicative of a parameter of interest. The term "information" as used herein includes any form of information (analog, digital, EM, printed, etc.), and may include one or more of: raw data, processed data, and signals. When the information has a high granularity bearing directly on the instrument sensor response (tool response) to the physical phenomena, it may be referred to as raw logging data. Logging data is quite voluminous by its nature. One prominent characteristic of raw logging data is that it may be subject to further processing to estimate parameters of interest, and that the particular algorithms used in this processing is subject to change over time and in light of the circumstances and operating environment. Thus, to properly conduct well operations remotely, logging data current to the measurement operation is a requirement for remote subject matter experts.

Method embodiments in accordance with the present disclosure may include estimating a parameter of interest from the information, evaluating the formation using the parameter of interest, and/or performing further borehole or formation operations in dependence upon the information, the evaluation, or the parameter. In particular embodiments, a state of drilling operations, characteristics of the borehole or formation, or orientation of components of the downhole tool may be estimated using the parameter of interest, and then used in performing an operation as described above.

The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Indeed, as will become apparent, the teachings of the present disclosure can be utilized for a variety of well tools and in all phases of well construction and production. Accordingly, the embodiments discussed below are merely illustrative of the applications of the present disclosure.

Referring to FIG. 1A, well logging instruments 10*a*, 10*b*, and 10*c* are shown being lowered into a wellbore 2 penetrating earth formations 13. The instruments 10*a*, 10*b*, and 10*c* may be lowered into the wellbore 2 and withdrawn therefrom by a conveyance device comprising tool 10 and an armored electrical cable 14. The cable 14 and tool 10 may include embedded conductors for power and/or data for providing signal and/or power communication between the surface and downhole instruments (e.g., a seven conductor cable). The cable 14 can be spooled by a winch 7 or similar device known in the art. The cable 14 may be electrically connected to a data acquisition management system 89 which can include a signal decoding and interpretation unit 16 and a recording unit 12. Signals transmitted by the tool 10 along the cable 14 can be decoded, interpreted, recorded and processed by the respective units in the system 89.

In one embodiment, circuitry associated with the tool 10 and instruments 14 (described in further detail below with respect to FIG. 2) may be configured to take measurements as the tool moves along the longitudinal axis of the borehole ('axially'). These instruments 10*a*, 10*b*, 10*c* may generate a signal in response to physical phenomena indicative of properties of the formation (including, for example, "behind-casing evaluation"), the wellbore, the fluid, and so on ('parameters of interest').

These parameters of interest may include information relating to a geological parameter, a geophysical parameter, a petrophysical parameter, and/or a lithological parameter. Thus, the tool 10 may include instruments including sensors for detecting physical phenomena indicative of parameters of interest such as, for example, formation resistivity, dielectric constant, the presence or absence of hydrocarbons, acoustic density, bed boundary, formation density, nuclear density and certain rock characteristics, permeability, capillary pressure, relative permeability, and so on. As one example, this measurement information, produced using instrument 10*a*, may be used to generate a resistivity image of the borehole 2 or another electrical parameter of interest of a formation 13, and additional instruments 10*b* and 10*c* may be used to take nuclear and acoustic measurements in the borehole.

For example, the wireline logging tool may be configured to measure one or more of the following values associated with the formation: (i) a resistivity value, (ii) a density value, (ii) a porosity value, (iii) a natural radiation value, (iv) a borehole image, (v) an acoustic travel time value, (vi) a nuclear magnetic resonance value, (vii) a pressure value, (viii) a well production value, (ix) a residual hydrocarbon saturation value, and (x) a temperature value, and so on. These measurements may be substantially continuous, which may be defined as being repeated at very small increments of depth and/or azimuth, such that the resulting information has sufficient scope and resolution to provide an image of borehole parameters (e.g., properties of the formation at the borehole).

Systems in accordance with the present disclosure may alternatively include a conventional derrick and a conveyance device, which may be rigid or non-rigid, and which may be configured to convey the downhole tool 10 in the wellbore. Drilling fluid ('mud') may be present in the borehole. The carrier may be a drill string, coiled tubing, a slickline, an e-line, a wireline, etc. Downhole tool 10 may be coupled or combined with additional tools. Thus, depending on the configuration, the tool 10 may be used during drilling and/or after the wellbore has been formed. While a land system is shown, the teachings of the present disclosure may also be utilized in offshore or subsea applications. The carrier may include a bottom hole assembly, which may include a drilling motor for rotating a drill bit.

Data acquisition management system 89 receives signals from sensors of the instruments and other sensors used in the system 100 and processes such signals according to programmed instructions provided to the data acquisition system 89. The data acquisition management system 89 may display desired parameters and other information on a display/monitor that is utilized by an operator. The data acquisition management system 89 may further communicate with a downhole control system at a suitable location on downhole tool 10. The data acquisition management system 89 may process data relating to the operations and data from instruments 10*a*, 10*b*, 10*c*, and may control one or more downhole operations performed by system 100.

Certain embodiments of the present disclosure may be implemented with a hardware environment 21 that includes an information processor 17, an information storage medium 13, an input device 11, processor memory 9, and may include peripheral information storage medium 19. The hardware environment may be in the well, at the rig, and/or at a remote location. Moreover, the several components of the hardware environment (or multiple hardware environments) may be distributed among those locations. The input device 11 may be any data reader or user input device, such as data card reader, keyboard, USB port, etc. The information storage medium 13 stores information provided by the detectors. Information storage medium 13 may include any non-transitory computer-readable medium for standard computer information storage, such as a USB drive, memory stick, hard disk, removable RAM, EPROMs, EAROMs, flash memories and optical disks or other commonly used memory storage system known to one of ordinary skill in the art including Internet based storage. Information storage medium 13 stores a program that when executed causes information processor 17 to execute the disclosed method. Information storage medium 13 may also store the formation information provided by the user, or the formation information may be stored in a peripheral information storage medium 19, which may be any standard computer information storage device, such as a USB drive, memory stick, hard disk, removable RAM, or other commonly used memory storage system known to one of ordinary skill in the art including Internet based storage. Information processor 17 may be any form of computer or mathematical processing hardware, including Internet based hardware. When the program is loaded from information storage medium 13 into processor memory 9 (e.g. computer RAM), the program, when executed, causes information processor 17 to retrieve detector information from either information storage medium 13 or peripheral information storage medium 19 and process the information to estimate a parameter of interest. Information processor 17 may be located on the surface or downhole.

The term "information" as used herein includes any form of information (analog, digital, EM, printed, etc.). As used herein, a processor is any information processing device that transmits, receives, manipulates, converts, calculates, modulates, transposes, carries, stores, or otherwise utilizes information. In several non-limiting aspects of the disclosure, an information processing device includes a computer that executes programmed instructions for performing various methods. These instructions may provide for equipment operation, control, data collection and analysis and other functions in addition to the functions described in this disclosure. The processor may execute instructions stored in computer memory accessible to the processor, or may employ logic implemented as field-programmable gate arrays ('FPGAs'), application-specific integrated circuits ('ASICs'), other combinatorial or sequential logic hardware, and so on.

One point of novelty of the system illustrated in FIG. 1A is that the at least one processor may be configured to perform certain methods (discussed below) that are not in the prior art. A surface control system or downhole control system may be configured to control the tool described above and any incorporated sensors and to estimate a parameter of interest according to methods described herein.

Aspects of the present disclosure are subject to application in various different embodiments. In some general embodiments, the carrier is implemented as a tool string of a drilling system, and the acoustic wellbore logging may be characterized as "logging-while-drilling" (LWD) or "measurement-while-drilling" (MWD) operations.

Figure 1B:
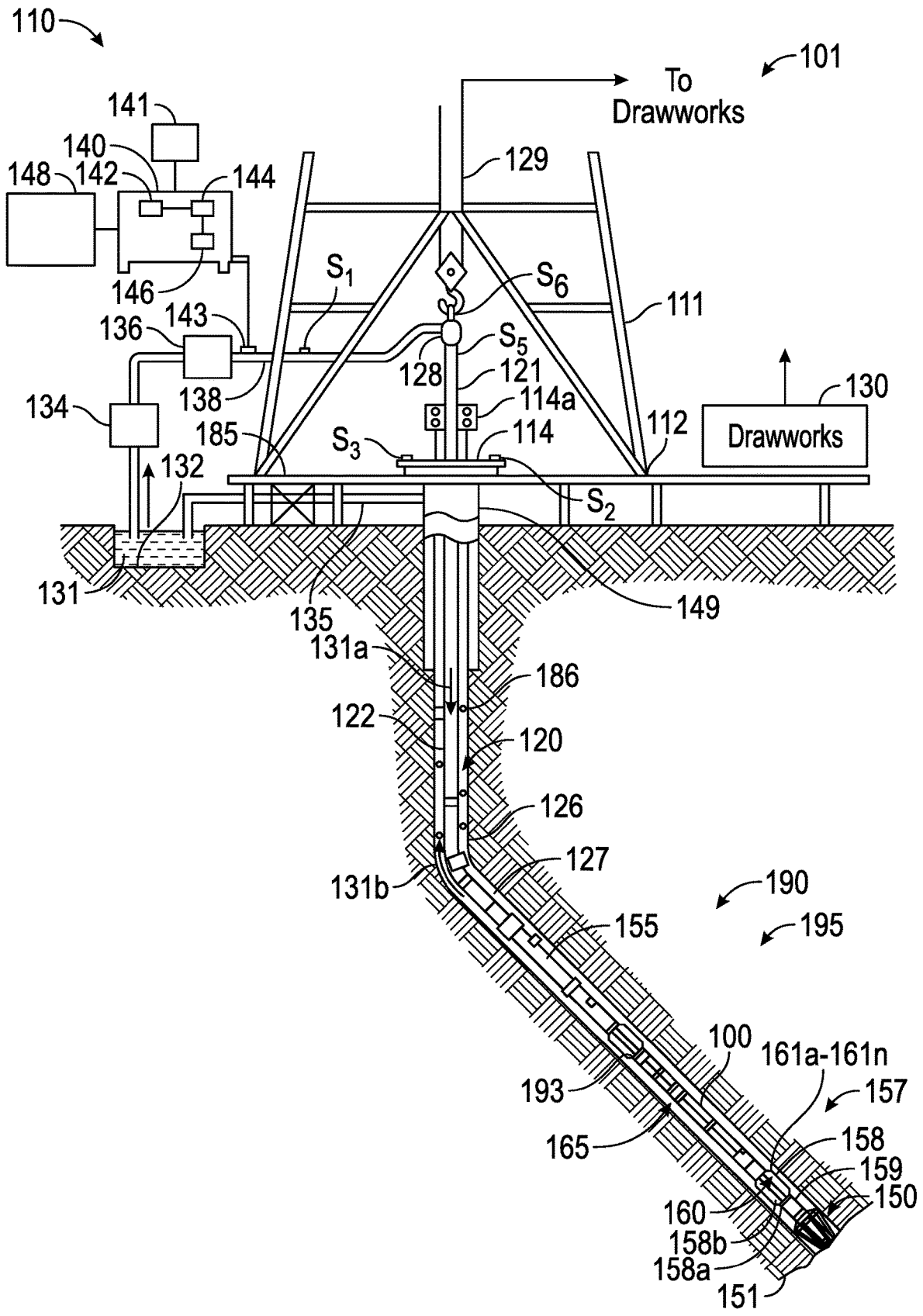
FIG. 1B is a schematic diagram of an example drilling system in accordance with embodiments of the present disclosure.

FIG. 1B is a schematic diagram of an exemplary drilling system 101 according to one embodiment of the disclosure. FIG. 1B shows a drill string 120 that includes a bottomhole assembly (BHA) 190 conveyed in a borehole 126. The drilling system 101 includes a conventional derrick 111 erected on a platform or floor 112 which supports a rotary table 114 that is rotated by a prime mover, such as an electric motor (not shown), at a desired rotational speed. A tubing (such as jointed drill pipe 122), having the drilling assembly 190, attached at its bottom end extends from the surface to the bottom 151 of the borehole 126. A drill bit 150, attached to drilling assembly 190, disintegrates the geological formations when it is rotated to drill the borehole 126. The drill string 120 is coupled to a drawworks 130 via a Kelly joint 121, swivel 128 and line 129 through a pulley. Drawworks 130 is operated to control the weight on bit ("WOB"). The drill string 120 may be rotated by a top drive (not shown) instead of by the prime mover and the rotary table 114. Alternatively, a coiled-tubing may be used as the tubing 122. A tubing injector 114*a* may be used to convey the coiled-tubing having the drilling assembly attached to its bottom end. The operations of the drawworks 130 and the tubing injector 114*a* are known in the art and are thus not described in detail herein.

A suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular discharges at the borehole bottom 151 through openings in the drill bit 150. The returning drilling fluid 131*b* circulates uphole through the annular space 127 between the drill string 120 and the borehole 126 and returns to the mud pit 132 via a return line 135 and drill cutting screen 185 that removes the drill cuttings 186 from the returning drilling fluid 131*b*. A sensor S1 in line 138 provides information about the fluid flow rate. A surface torque sensor S2 and a sensor S3 associated with the drill string 120 respectively provide information about the torque and the rotational speed of the drill string 120. Tubing injection speed is determined from the sensor S5, while the sensor S6 provides the hook load of the drill string 120.

Well control system 147 is placed at the top end of the borehole 126. The well control system 147 includes a surface blow-out-preventer (BOP) stack 115 and a surface choke 149 in communication with a wellbore annulus 127. The surface choke 149 can control the flow of fluid out of the borehole 126 to provide a back pressure as needed to control the well.

In some applications, the drill bit 150 is rotated by only rotating the drill pipe 122. However, in many other applications, a downhole motor 155 (mud motor) disposed in the BHA 190 also rotates the drill bit 150. The rate of penetration (ROP) for a given BHA largely depends on the WOB or the thrust force on the drill bit 150 and its rotational speed.

A surface control unit or controller 140 receives signals from the downhole sensors and devices via a sensor 143 placed in the fluid line 138 and signals from sensors S1-S6 and other sensors used in the system 101 and processes such signals according to programmed instructions provided to the surface control unit 140. The surface control unit 140 displays desired drilling parameters and other information on a display/monitor 141 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole, and may control one or more operations of the downhole and surface devices. The data may be transmitted in analog or digital form. Thus, surface control unit 140 is analogous in many ways to system 89, as described in FIG. 1A.

The BHA 190 may also contain formation evaluation sensors or devices (also referred to as measurement-while-drilling ("MWD") or logging-while-drilling ("LWD") sensors) determining resistivity, density, porosity, permeability, acoustic properties, nuclear-magnetic resonance properties, formation pressures, properties or characteristics of the fluids downhole and other desired properties of the formation 195 surrounding the BHA 190. Such sensors are generally known in the art and for convenience are generally denoted herein by numeral 165, and include counterparts to sensors described above with respect to FIG. 1A. The BHA 190 may further include a variety of other sensors and devices 159 for determining one or more properties of the BHA 190 (such as vibration, bending moment, acceleration, oscillations, whirl, stick-slip, etc.), drilling operating parameters (such as weight-on-bit, fluid flow rate, pressure, temperature, rate of penetration, azimuth, tool face, drill bit rotation, etc.). For convenience, all such sensors are denoted by numeral 159.

The BHA 190 may include a steering apparatus or tool 158 for steering the drill bit 150 along a desired drilling path. In one aspect, the steering apparatus may include a steering unit 160, having a number of force application members 161*a*-161*n*. The force application members may be mounted directly on the drill string, or they may be at least partially integrated into the drilling motor. In another aspect, the force application members may be mounted on a sleeve, which is rotatable about the center axis of the drill string. The force application members may be activated using electro-mechanical, electro-hydraulic or mud-hydraulic actuators. In yet another embodiment the steering apparatus may include a steering unit 158 having a bent sub and a first steering device 158*a* to orient the bent sub in the wellbore and the second steering device 158*b* to maintain the bent sub along a selected drilling direction. The steering unit 158, 160 may include near-bit inclinometers and magnetometers.

The drilling system 101 may include sensors, circuitry and processing software and algorithms for providing information about desired drilling parameters relating to the BHA, drill string, the drill bit and downhole equipment such as a drilling motor, steering unit, thrusters, etc. Many current drilling systems, especially for drilling highly deviated and horizontal wellbores, utilize coiled-tubing for conveying the drilling assembly downhole. In such applications a thruster may be deployed in the drill string 190 to provide the required force on the drill bit.

Exemplary sensors for determining drilling parameters include, but are not limited to drill bit sensors, an RPM sensor, a weight on bit sensor, sensors for measuring mud motor parameters (e.g., mud motor stator temperature, differential pressure across a mud motor, and fluid flow rate through a mud motor), and sensors for measuring acceleration, vibration, whirl, radial displacement, stick-slip, torque, shock, vibration, strain, stress, bending moment, bit bounce, axial thrust, friction, backward rotation, BHA buckling, and radial thrust. Sensors distributed along the drill string can measure physical quantities such as drill string acceleration and strain, internal pressures in the drill string bore, external pressure in the annulus, vibration, temperature, electrical and magnetic field intensities inside the drill string, bore of the drill string, etc. Suitable systems for making dynamic downhole measurements include COPILOT, a downhole measurement system, manufactured by BAKER HUGHES INCORPORATED.

The drilling system 101 can include one or more downhole processors at a suitable location such as 193 on the BHA 190. The processor(s) can be a microprocessor that uses a computer program implemented on a suitable non-transitory computer-readable medium that enables the processor to perform the control and processing. The non-transitory computer-readable medium may include one or more ROMs, EPROMs, EAROMs, EEPROMs, Flash Memories, RAMs, Hard Drives and/or Optical disks. Other equipment such as power and data buses, power supplies, and the like will be apparent to one skilled in the art. In one embodiment, the MWD system utilizes mud pulse telemetry to communicate data from a downhole location to the surface while drilling operations take place. While a drill string 120 is shown as a conveyance device for sensors 165, it should be understood that embodiments of the present disclosure may be used in connection with tools conveyed via rigid (e.g. jointed tubular or coiled tubing) as well as non-rigid (e. g. wireline, slickline, e-line, etc.) conveyance systems. The drilling system 101 may include a bottomhole assembly and/or sensors and equipment for implementation of embodiments of the present disclosure on either a drill string or a wireline.

Control of these components may be carried out using one or more models using methods described below. For example, surface processor 142 or downhole processor 193 may be configured to modify drilling operations i) autonomously upon triggering conditions, ii) in response to operator commands, or iii) combinations of these. Such modifications may include changing drilling paramaters, mud parameters, and so on. Control of these devices, and of the various processes of the drilling system generally, may be carried out in a completely automated fashion or through interaction with personnel via notifications, graphical representations, user interfaces and the like. Additionally or alternatively, surface processor or downhole processor may be configured for the creation of the model. Reference information accessible to the processor may also be used.

In some general embodiments, surface processor 142, downhole processor 193, or other processors (e.g. remote processors) may be configured to operate the well logging tool 110 to make well logging measurements. Each of these logical components of the drilling system may be implemented as electrical circuitry, such as one or more integrated circuits (ICs) operatively connected via a circuit board in accordance with techniques of the present disclosure.

Figure 2:
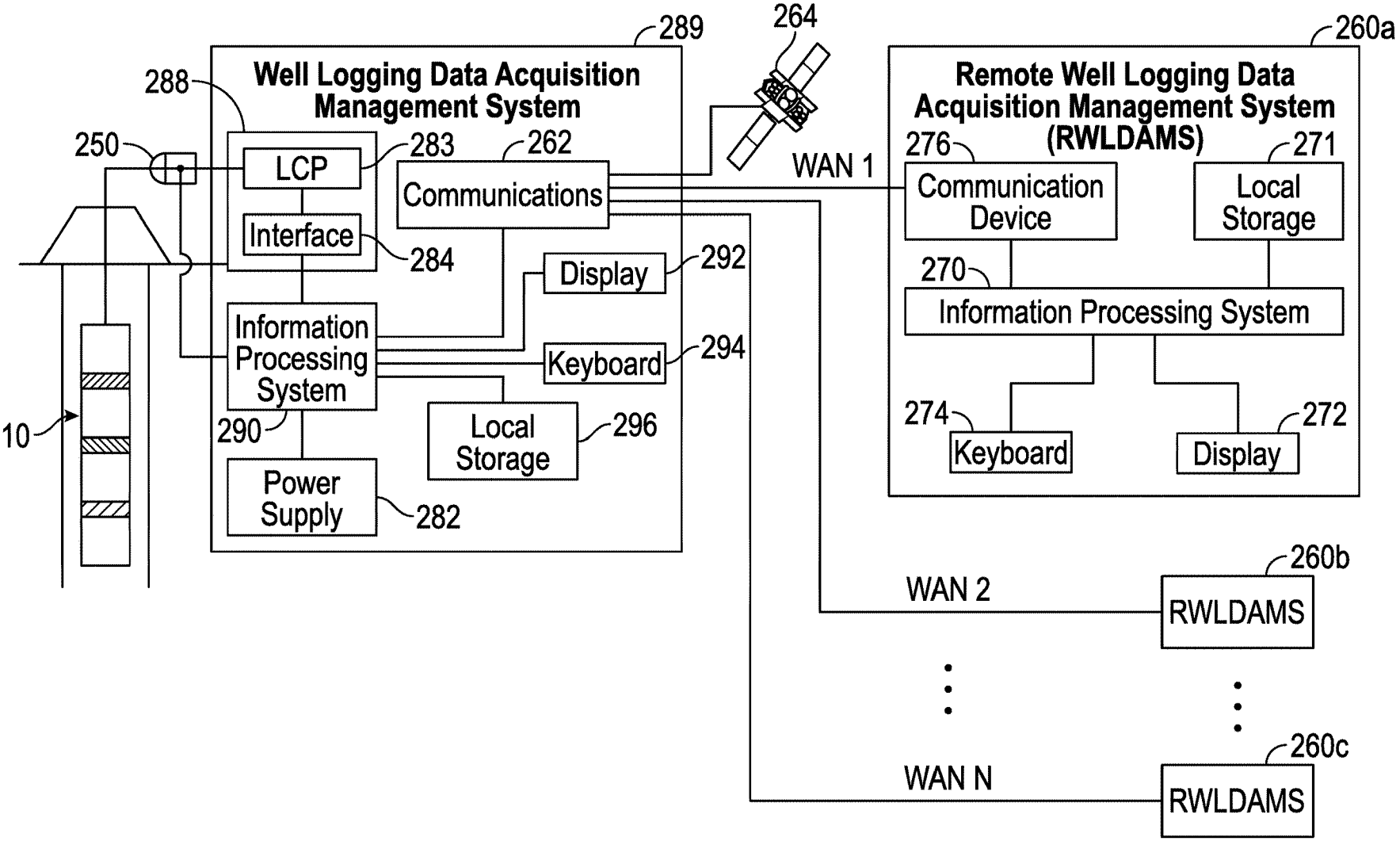
FIG. 2 illustrates a system for remote well logging in accordance with embodiments of the present disclosure.

FIG. 2 illustrates a system for remote well logging in accordance with embodiments of the present disclosure. System 200 includes a local well logging data acquisition management system 289 at the logging site (e.g., local control system), a plurality of remote well logging data acquisition management systems 260*a*, 260*b* . . . 260*n* located at remote locations from the local well logging data acquisition management system 289, several wide area networks (WANs) for networked communication, and a satellite system 264 for dedicated communications.

The local well logging data acquisition management system 289 may be in part a legacy well logging system. System 289 may include a data acquisition system 288 configured to communicate directly with the tool 10 over a data communications cable (e.g., armored wireline cable 14) in ways well known in the art, as well as communications system 262, display 292, input device 294 (e.g., keyboard, mouse, etc), and local data storage 296.

The data acquisition system 288 may include a line control panel and an interface 284. The data acquisition system 288 receives raw logging data from the logging tool 10 via the cable 14 and passes the data to the information processing system 290, which may be implemented as a specially configured industrial computer. The data acquisition system 288 is also configured to receive operational commands from the information processing system 290 and to pass the operational commands to the logging tool 10.

The information processing system 290 is configured to receive commands from remote well logging data acquisition management systems 260*a*, 260*b* . . . 260*n* and to control operation of the logging tool 10 in response to the commands, as well as cooperating with remote well logging data acquisition management systems 260*a*, 260*b* . . . 260*n* to store data remotely, including generation of control signals to induce the communications system 262 to transmit communication signals carrying the acquired raw logging data.

The information processing system 290 is also configured to carry out other processes at the well site, including presentation of representations of raw logging data on display 292, processing of raw logging data according to one or more algorithms to estimate parameters of interest, performing diagnostic tests on components of the system, generation of control signals to induce the power supply 282 to toggle and adjust the supply of power to the logging tool 10 (including cessation of supplying power to the logging tool), and generation of control signals to control movement of the hoist 250 (e.g., to move the tool 10 to a predetermined position, to begin the movement of a logging run, to increase or decrease tension, etc.). The information processing system 290 may also be configured to store logging data in local storage 296, to monitor conditions of WANs and satellite transmissions, and to carry out methods of the present disclosure as described in further detail below.

Each of the remote well logging data acquisition management systems executes its own instance of a remote well operation control host, and the local well operation control host is running on the local well logging data acquisition management system 282, as discussed in greater detail with reference to FIG. 3.

Each of the remote well logging data acquisition management systems 260*a*, 260*b* . . . 260*n* is configured for transmitting well-logging commands to the local well logging data acquisition management system 289 as digital communication signals a WAN or the satellite system 264 to the well logging data acquisition management system 289, in order to control a first logging instrument 10*a*, a second logging instrument 10*b*, or a conveyance device (e.g., cable hoist 250). The remote well operation control host running on information processing system 270 of systems 260*a* . . . 260*n* is also configured to receive data via the local well operation control host on the corresponding well logging data acquisition management system at the logging site so as to mirror raw well logging data (from instruments on the tool 10 and acquired by the local well operation control host) to local storage 271. Representations of mirrored data may be presented to a remote well operator on a display 272, and remote subject matter experts at each of the remote well logging data acquisition management systems 260*a*, 260*b* . . . 260*n* may control operations of one of the corresponding instrument by specifying commands using an input device 274 (e.g., keyboard, mouse, etc.).

The information processing system 270 is configured to allow an operator to specify one or more commands (e.g., well operation commands) in substantially real-time in dependence upon raw well logging data received in substantially real-time. The logging data may comprise substantially all the raw well logging data from a particular process (e.g., test), instrument, or substantially including all the raw well logging data acquired locally (including all the raw well logging data transmitted uphole from the tool(s)). A command may comprise any instruction (e.g., input value, or selected value) for controlling well operations at the logging site, including, for example, operation of the logging tool, the hoist device, or the power supply. For example, commands may comprise one or more of the following: (i) an instruction to perform measurement of a specific geological or down hole parameter, (ii) an instruction to actuate a device in the logging tool, (ii) an instruction for moving the logging tool from a first position, (iii) an instruction for applying power to the logging tool or to the hoist device, (iv) an instruction for removing power from the logging tool or from the hoist device, (v) an instruction for modifying measurement parameters utilized by the logging tool and (vi) an instruction for performing a diagnostic test on a computer or the logging tool.

Networked and non-networked communications between well site and remote sites, as well as data acquisition, may be conventionally conducted. See for example, U.S. Pat. No. 7,305,305 to Beeson, U.S. Pat. No. 7,672,262 to McCoy et al., U.S. Pat. No. 6,046,685 to Tubel, U.S. Pat. No. 6,980,929 to Aronstam et al., and U.S. Pat. No. 5,959,547 to Tubel et al., each commonly owned with the present application and incorporated herein by reference in its entirety. See also U.S. patent application publication No.: US 2007/0237402 to Dekel et al., U.S. Pat. No. 6,842,768 to Shaffer et al., and U.S. Pat. No. 6,139,197 to Banks.

In one example, the plurality of remote well logging data acquisition management systems 260*a*, 260*b* . . . 260*n* are located onshore and the local control system 262 can be located on a drilling or production oil rig located offshore. Alternatively, the plurality of remote well logging data acquisition management systems 260*a*, 260*b* . . . 260*n* may be at locations not visible from the local control system 262, such as in different states or countries.

Figure 3:
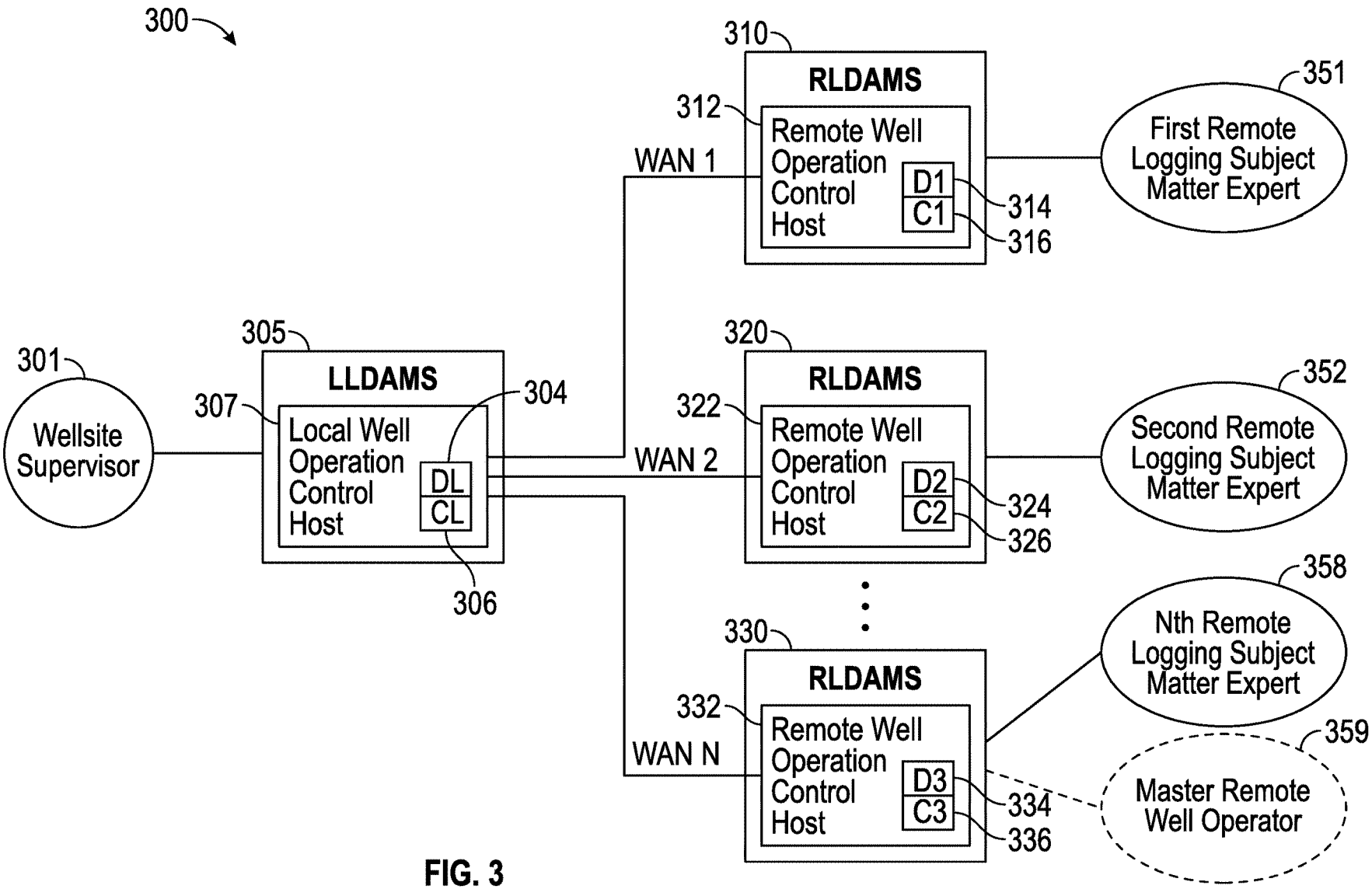
FIG. 3 illustrates a distributed software architecture in accordance with embodiments of the present disclosure.

FIG. 3 illustrates a distributed software architecture in accordance with embodiments of the present disclosure. The system 300 includes a local well operation control host 307 on a corresponding well logging data acquisition management system 305 at the logging site, and a plurality of remote well operation control hosts 312, 322, 332 instantiated and operating on corresponding remote well logging data acquisition management systems 310, 320, 330, respectively. Each instance includes a configurations file 304, 314, 324, 334 with information pertaining to particular instruments, tools, infrastructure, formation, local conditions, operations to be conducted, and so on. The configurations file may be modified at any of the local well operation control host 307 or the plurality of remote well operation control hosts 312, 322, 332 by interaction with personnel at the system or through automated control in response to detected conditions. Each instance also includes links to locally stored copies of raw logging data 304, 314, 324, 334. Each remote well logging data acquisition management system 310, 320, 330 may be specifically configured to conduct operations with respect to particular instruments or logging operations (e.g., services) conducted on a particular instrument, in effect configuring the systems as instrument (or service) control centers.

A first remote well logging subject matter expert(s) 351 may interact with remote well operation control host 312 to conduct well operations relating to a first instrument. For example, the subject matter expert 351 may be a nuclear physicist conducting gamma ray spectroscopy. The local well operation control host or the remote well operation control host may bin recorded gamma rays as a function of the voltage level each gamma ray generates in the measurement instrument. The recorded gamma ray spectrum may then be provided as a function of the channels. The channels in the abstract are not meaningful for gamma ray spectroscopy applications, but become useful if they converted to a representation in terms of energy. Thus, the physicist may map spectra recorded in terms of channels into spectra expressed in terms counts with respect to energy, by finding the relevant peaks with known energy levels and then generating a transfer function based on what channel those peaks are located. The physicist may adjust the gain, gate timing, or other variables of radiation detectors downhole during the measurement operations.

A second remote well logging subject matter expert(s) 352 may interact with remote well operation control host 322 to conduct well operations relating to a second instrument. For example, the subject matter expert 352 may be a resistivity imaging specialist. The specialist may adjust instrument operations, for example, to correct for invasion and shoulder beds, dip, anisotropy, and effects of surrounding beds.

Another remote well logging subject matter expert(s) 358 may interact with remote well operation control host 332 to conduct well operations relating to a third instrument. For example, the subject matter expert 358 may be a borehole acoustic specialist. The specialist may optimize the output power of an acoustic wavetrain emitted from a transducer rotatably mounted in a downhole borehole televiewer for scanning the sidewall of the borehole, in order to prevent destructive interference between the caudal portion of the outgoing wave train and the returning echo signals from the borehole sidewall. This may be accomplished by discretely controlling the amplitude level of the excitation voltage applied to the acoustic transducer.

In embodiments, each of the remote well operation control hosts may be configured to receive all or portions of the raw logging data for all the instruments at the well site. Logging data from additional instruments are often helpful, and in some circumstances may be critical, in adjusting an instrument or interpreting results. In some implementations, the amount of data received from the other instruments may be determined in dependence upon data transfer characteristics of the network, as described in further detail below. Optionally, a master remote well operator 359 may coordinate control of the instruments and the conveyance device by each of the subject matter experts, either through permissions, or communications to each well operation control host.

Figure 4:
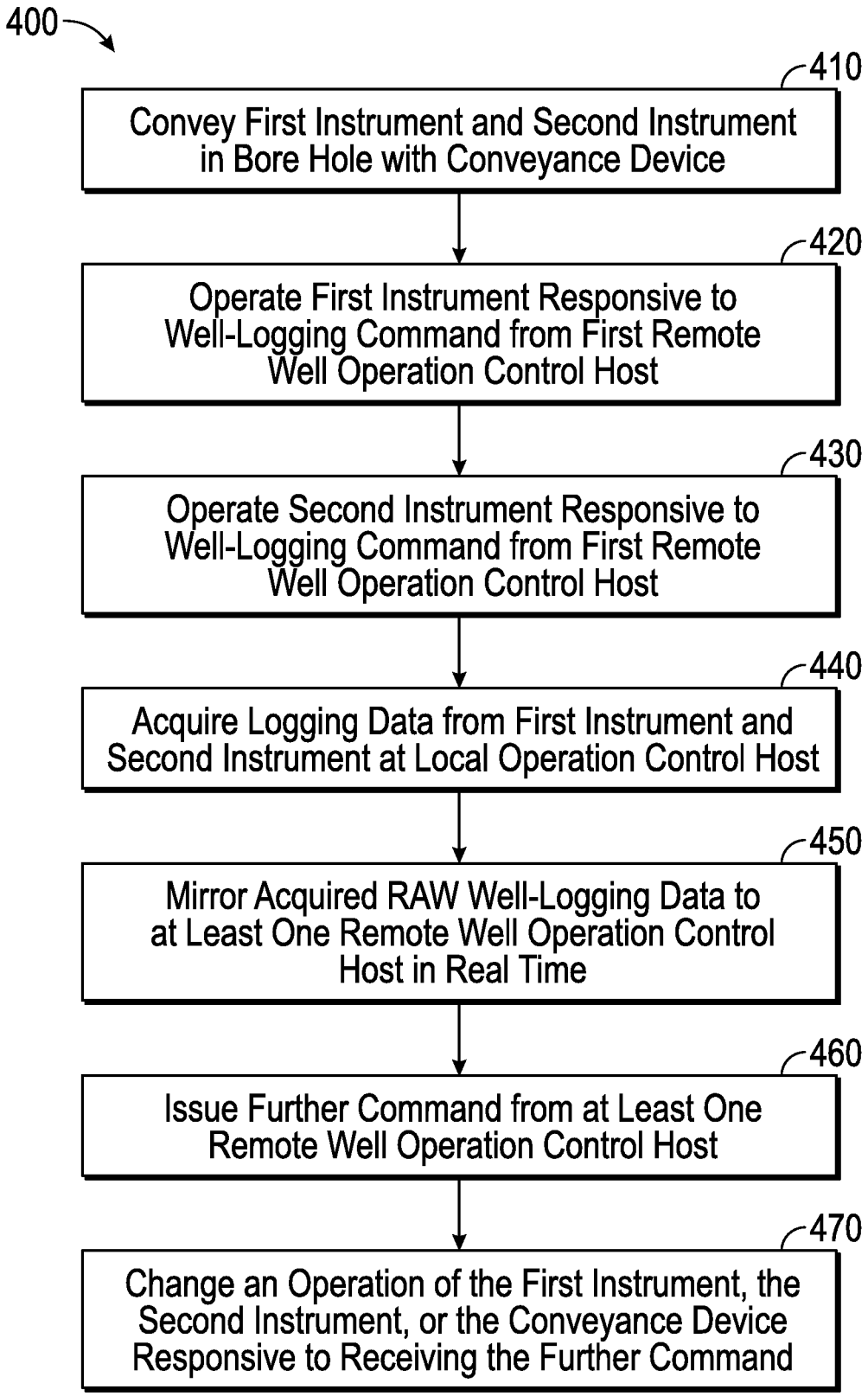
FIG. 4 illustrates methods of remote well logging in accordance with embodiments of the present disclosure.

FIG. 4 illustrates methods of remote well logging in accordance with embodiments of the present disclosure. Method 400 may include conducting, with a plurality of remote well operation control hosts operating on corresponding remote well logging data acquisition management systems, a well logging operation using a well logging system at a logging site, wherein the well logging system includes a conveyance device having disposed thereon a first logging instrument and a second logging instrument.

Step 410 of method 400 may comprise conveying a first well logging instrument and a second well logging instrument in a borehole using a conveyance device, such as, for example, a tool supported by a wireline cable. Step 420 may comprise operating the first logging instrument responsive to at least one well-logging command from a first remote well operation control host of the plurality; and step 430 may comprise operating the second logging instrument responsive to at least one well-logging command from a second remote well operation control host of the plurality different than the first. Operating the instruments may include, for example, changing a setting on the instrument which affects characteristics of the well logging data produced. In one example, a gain setting of the instrument may be increased or decreased to improve accuracy, resolution, and so on.

Step 440 may comprise acquiring raw well logging data from the first logging instrument and the second logging instrument by a local well operation control host on a corresponding well logging data acquisition management system at the logging site, such as, for example by using the system architecture described in greater detail above. Step 450 may comprise mirroring the acquired raw well logging data to at least one of the plurality of remote well operation control hosts in substantially real time. Due to the voluminous nature of raw data, the tenuous nature of communications over portions of the WAN for particular well sites, and the substantially real-time specifications for this step, raw logging data and system status/controls may be recorded in several local and remote computers and system components may be configured with failover procedures to ensure continuous operation with no data loss under communication interruptions or equipment malfunctions, as described in further detail below. This may be carried out in part by synchronizing the plurality of remote well operation control hosts with the local well operation control host. The logging data at the local well operation control host may be processed identically and in parallel with the logging data at the plurality of remote well operation control hosts and may maintain mirrored sets of control data.

Step 460 may comprise issuing a further command from at least one of the plurality of remote well operation control hosts responsive to the acquired raw well logging data. Methods may include using the logging data to control the logging operation with at least one second command in substantially real-time from the at least one of the plurality of remote well operation control hosts responsive to the logging data received. Step 470 may comprise changing the operation of at least one of the first instrument, the second instrument, and the conveyance device responsive to receiving the further command. The further command may result in toggling an instrument on or off, adjusting gain, adjusting gate settings, adjusting the length of time a tool is energized, reclogging a section of the wellbore, or (in the case of MWD tools) may result in steering the path of the drill bit, stopping drilling, and so on.

Figure 5A:
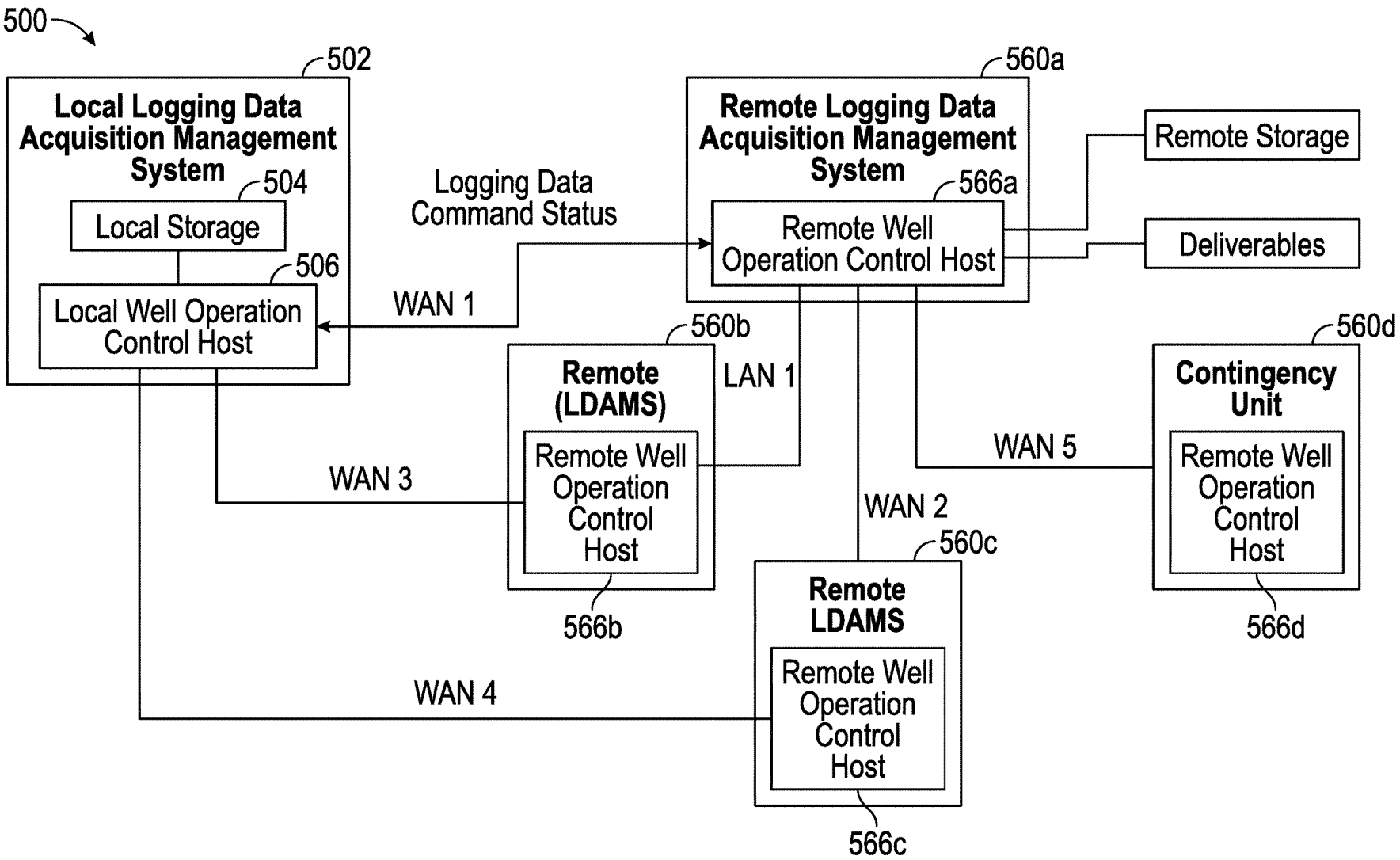
FIGS. 5A-5D illustrate systems for remote well logging in accordance with embodiments of the present disclosure.

FIGS. 5A-5D illustrate systems for remote well logging in accordance with embodiments of the present disclosure. Referring to FIG. 5A, system 500 includes a local well logging data acquisition management system 502 at the logging site (e.g., local control system), a plurality of remote well logging data acquisition management systems 560*a*, 560*b*, 560*c*, 560*d* located at remote locations from the local well logging data acquisition management system 502 and several wide area networks (WANs) for networked communication.

The local well logging data acquisition management system (local LDAMS) 502 may include local data storage 504. Local LDAMS 502 executes an instance of a local well operation control host 506 for acquisition of well logging data from the well site infrastructure and storage of raw logging data in local data storage 504, connecting with remote well operation control hosts as described above for remote control of logging instruments, and mirroring the raw logging data from local storage to remote well operation control hosts 566 in substantially real time. The local well operation control host 506 may also be configured to monitor conditions of WANs and satellite transmissions, and to carry out methods of the present disclosure as described in further detail below. Each of the remote well logging data acquisition management systems 560*a*, 560*b*, 560*c*, 560*d* is executing its own instance of a remote well operation control host 566*a*, 566*b*, 566*c*, 566*d*.

Functionality and responsibilities of various remote well operation control hosts may vary within a system. A first remote well operation control host 566*a* may function as a master remote well operation control host, which may control carrier operation and assign control of instruments or other logging infrastructure to other remote well operation control hosts 566*b*, 566*c*, 566*d*, etc. In some examples, logging data and/or commands may be routed through the remote well logging data acquisition management system 560*a* associated with the master remote well operation control host 566*a*, where the data may be stored and distributed to the other remote well operation control hosts 566*b*, 566*c*, 566*d*, such as, for example, through a LAN connecting the other remote well logging data acquisition management systems 560*b*, 560*c*, 560*d* to the first remote well logging data acquisition management systems 560*a* (and possibly each other). In other examples, each remote well operation control host 566*a*, 566*b*, 566*c*, 566*d* may be fully network connected.

Each of the remote well operation control hosts 566*a*, 566*b*, 566*c*, 566*d* may have a unique function. Example techniques in accordance with embodiments of the present disclosure may include conveying the conveyance device to intersect a volume of interest relating to the first logging instrument via tool commands from a first of the plurality of remote well operation control hosts. Upon the device intersecting the volume of interest, control of the conveyance device may then be assigned from the first of the plurality of remote well operation control hosts to a second of the plurality of remote well operation control hosts. Thus, a team of specialists trained and experienced in finding the volume of interest may operate from a first remote well logging data acquisition management system 560*a* utilizing a first remote well operation control host 566*a*, while individual well operations engineers specializing in measurement operations with the instruments may each operate from other remote well logging data acquisition management systems 560*b*, 560*c* utilizing a specific corresponding remote well operation control host 566*b*, 566*c*. In one example, infrequent and delicate operations, such as, for example, a tool becoming stuck in the wellbore, may be delegated to a contingency unit 560*d* (which may utilize a specially configured remote well operation control host 566*d*), where specialists in contingency actions may alleviate the condition (e.g., a stuck condition of the tool string, kick detection, etc.). Alternatively, control may automatically revert to the local well operation control host 506.

During a logging operation, the local well operation control host 506 operates to transmit substantially all raw well logging data generated by the instruments from the logging site to at least one of the plurality of remote well operation control hosts over a WAN. The local and remote well hosts cooperatively use the logging data to control the logging operation with at least one second command in substantially real-time from the at least one of the plurality of remote well operation control hosts responsive to the logging data received. Aspects of the cooperative functionality of the local and remote hosts are implemented to remedy difficulties arising from the specific context of substantially real-time remote well logging. Connectivity issues make real-time remote well logging problematic. Connectivity issues are also endemic to many of the areas in which remote well logging may be employed. Thus, gracefully handling connectivity issues resulting in insufficient data transfer during remote well operations is critical to providing real-time control of well logging operations.

For example, systems of the present disclosure may implement contingent operational modes to provide failover. Local well operation control host 506, for instance, may determine a value for at least one data transfer characteristic of the WAN with respect to the at least one of the plurality of remote well operation control hosts. Example data transfer characteristics may include metrics corresponding to throughput, downtime, failures, and the like. Local well operation control host 506 may conduct a comparison of the value for the at least one data transfer characteristic with at least one operational sufficiency profile. The contingent operational mode may be implemented in dependence upon the comparison. In other examples, contingency protocols may be implemented for non-data transfer contingencies, such as, for example, emergency conditions as detected from sensor information.

Each operational sufficiency profile may be representative of data transfer characteristic values indicating data transfer sufficient for control of the logging operation in substantially real-time to a standard equal to conventional on-site control. Heuristics, rules, ranges, or thresholds may be used. As one example, if average throughput falls below a first threshold rate for a period of time exceeding a second threshold duration, a contingent operational mode may be triggered. The contingent operational mode may include, for example, i) reducing logging speed; ii) storing logging information at another node; iii) ceding operational control of a logging instrument to a well operation control host local to the logging site; iv) ceding operational control of the carrier to a well operation control host local to the logging site; vi) ceding operational control of a logging instrument to another node; vii) ceding operational control of the carrier to another node; viii) repeating a logging interval; and ix) implementing a change in data compression schemes. Changes in compression schemes may be carried out using a variety of techniques.

In some examples, the implemented contingent operational mode may be selected from a plurality of available contingent operational modes from a configurations file. In embodiments, the contingent operational mode may be implemented in dependence upon an order of priority of at least one of logging data from each logging instrument or operations between each logging operation associated with a particular logging instrument. For example, data from instruments or processes having a lower priority may be pre-compressed prior to compression of the general data stream, or in some cases may be suspended altogether. Priority and criticality data may be stored as a configurations file, determined using heuristics, and so on.

As data transfer slows, receipt of logging data corresponding to one or more services may fall behind real-time. Catch-up of a particular stream of data may be moved up or down in priority (e.g., expedited or delayed, respectively), or forgone in lieu of more recent data, in accordance with the current operational mode. As an example, data from a secondary operation may be cached, and particular segments transmitted when correlated with a segment of interest corresponding to data from another instrument. In some examples, snapshots of downgraded data streams may be forwarded at intervals to conserve bandwidth.

In some instances a proxy (not shown) operating at the well site (e.g., executing on an information processing device shared by the local well logging host or on a system locally networked to the information processing device) is configured to receive commands from remote well operation control hosts 566*a*, 566*b*, 566*c*, 566*d* and to control operation of the logging tool 10 in response to the commands.

Figure 5B:
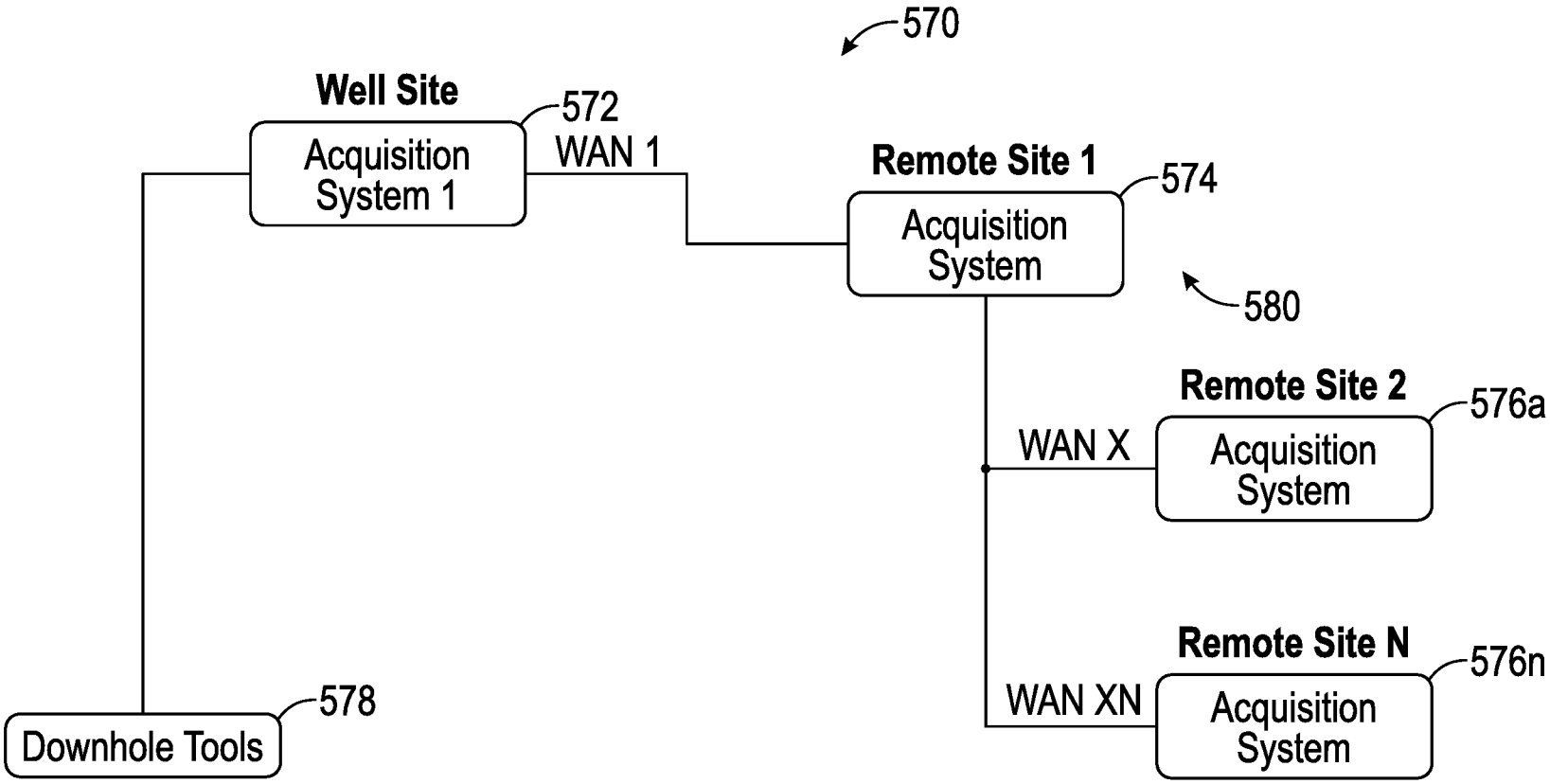

FIG. 5B illustrates another system for remote well logging in accordance with embodiments of the present disclosure. Embodiments described herein above include implementations wherein remote sites are each connected thru individual WAN links directly to the local logging data acquisition management system. However, in some operations, WAN links having broad bandwidths at high reliability (e.g., characteristic to WANs found in a typical city) may not be available.

System 570 features a local logging data acquisition management system 572 connected to a first remote logging data acquisition management system 574, along with additional remote logging data acquisition management systems 576*a* . . . 576*n* connected directly to the first remote logging data acquisition management system 574. In this case, the first remote logging data acquisition management system 574 may be located within a city where reliable large bandwidth networks are commonly available. The first remote logging data acquisition management system 574 may include a first remote well operation control host 580 which may function as a master remote well operation control host similarly to first remote well operation control host 566*a* (FIG. 5A). This reduces the multi-channel requirements for the local logging data acquisition management system 572 but increases the bandwidth requirements of the WAN link between the first remote logging data acquisition management system 574 and the local logging data acquisition management system 572. To provide the desired degree of redundancy additional WAN links (not shown) could be added in parallel between the first remote logging data acquisition management system 574 and the local logging data acquisition management system 572. Thus, system 570 includes multi-channel WAN capabilities of the local logging data acquisition management system while providing redundancy links useful as contingency data paths should some of the links become interrupted.

As described in greater detail with respect to FIG. 3 above, each remote well logging data acquisition management system may be specifically configured to conduct operations with respect to particular instruments or logging operations (e.g., services) conducted on a particular instrument in logging tool 578, in effect configuring the systems as instrument (or service) control centers. Because each subject matter specialist (or team of specialists) is freed from interacting with subject matter not in his or her area of expertise, the specialist is available to work on other well sites.

Figure 5C:
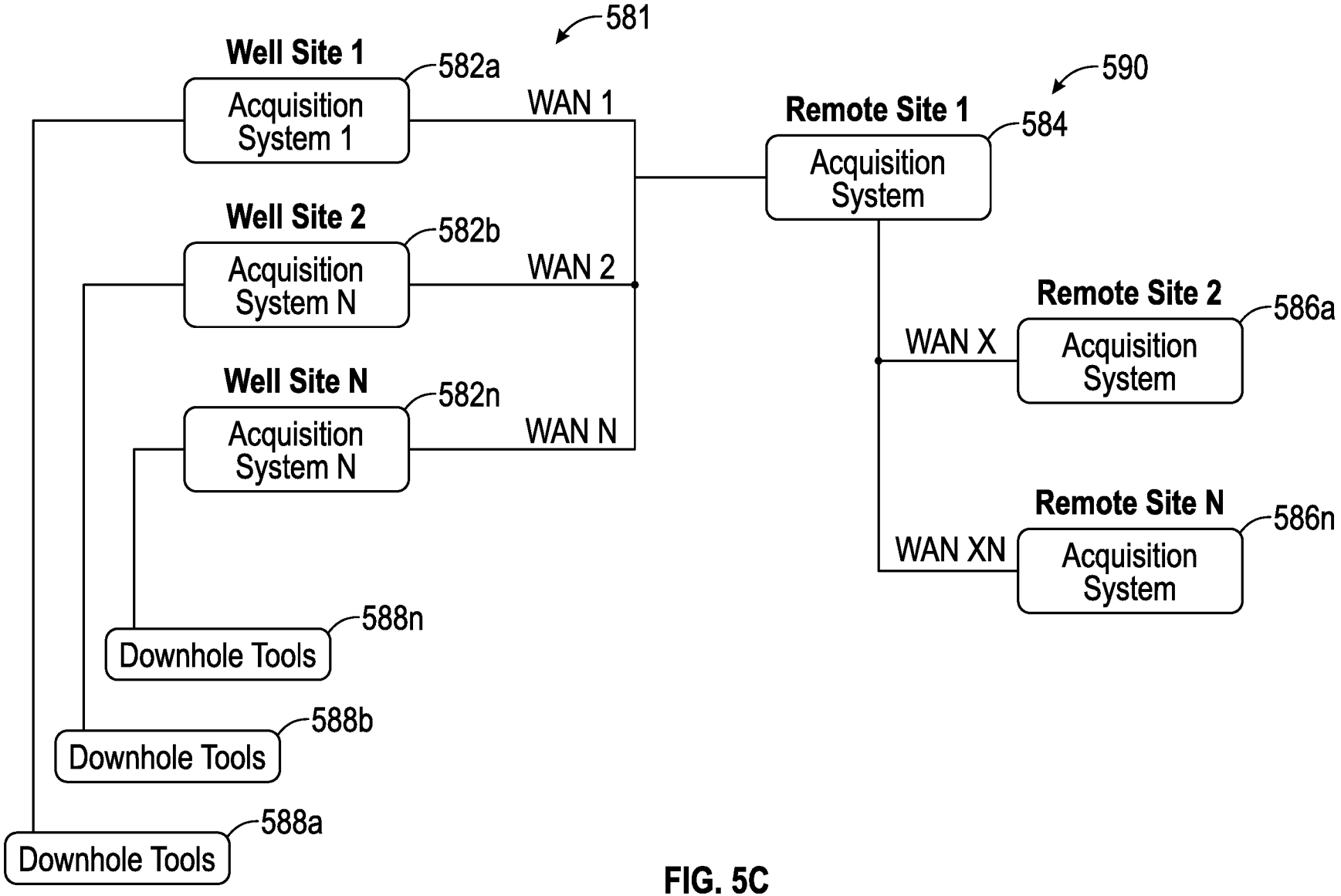

FIG. 5C illustrates another system for remote well logging in accordance with embodiments of the present disclosure. In system 581, multiple logging jobs at different well sites are effectively controlled from multiple remote sites. Each of local logging data acquisition management systems 582*a* . . . 582*n* are connected to first remote logging data acquisition management system 584 through individual WANs (WAN1 . . . WANn). In some implementations, multiple parallel WANs may be used to connect any or all local logging data acquisition management systems 582*a* . . . 582*n* to first remote logging data acquisition management system 584. Additional remote logging data acquisition management systems 586*a* . . . 586*n* are connected directly to the first remote logging data acquisition management system 584. The first remote logging data acquisition management system 584 may include a first remote well operation control host 590 which may function as a master remote well operation control host similarly to first remote well operation control host 566*a* (FIG. 5A). In any case, control of a particular subsystem, instrument, or logging operation with respect to a tool (588*a*, 588*b* . . . 588*n*) connected to each of local logging data acquisition management systems 582*a* . . . 582*n*, respectively, may be distributed to the corresponding subject matter expert at the appropriate additional remote logging data acquisition management system 586*a* . . . 586*n*.

In this configuration, one logging expert located in one of the remote sites (e.g., 586*a*) controls a variety of tools (e.g., 588*a*, 588*b* . . . 588*n*) which may be part of different tool strings being logged at multiple well sites. Although FIG. 5C shows all data traffic passing through the first remote logging data acquisition management system 584, this configuration is only one of many possible configurations which will occur to those of skill in the art in light of the present disclosure, and the logging of multiple well sites may be incorporated in any of the example systems described herein.

Figure 5D:
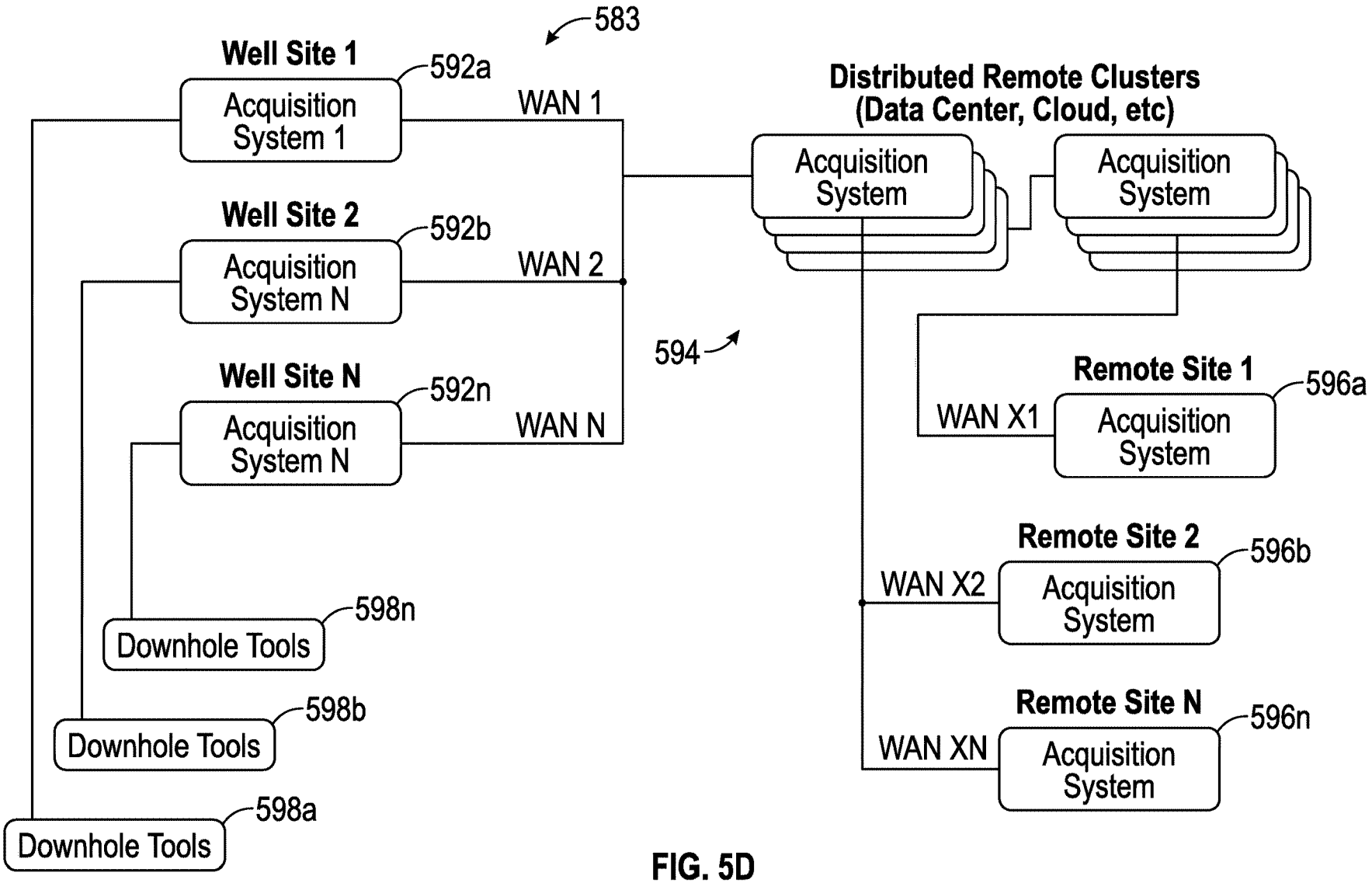

FIG. 5D illustrates another system for remote well logging in accordance with embodiments of the present disclosure. In system 583, multiple logging jobs at different well sites may be effectively controlled from multiple remote sites. Each of local logging data acquisition management systems 592*a* . . . 592*n* and remote logging data acquisition management systems 596*a* . . . 596*n* are connected to a highly available distributed remote cluster 594, which may comprise one or more data centers or cloud implementations. Distributed remote cluster 594 may be implemented using multiple redundant computing resources in different locations. Clustered resources may be managed through a virtualized master identity. Control of a particular subsystem, instrument, or logging operation with respect to a tool (598*a*, 598*b* . . . 598*n*) connected to each of local logging data acquisition management systems 592*a* . . . 592*n*, respectively, may be distributed to the corresponding subject matter expert at the appropriate additional remote logging data acquisition management system 596*a* . . . 596*n*. That is, jobs may be routed to a particular system based upon subject matter independent of the well site the data originates from. Thus, jobs from a particular well site may be parsed to operators at many locations, and an operator at a particular location may receive jobs of the same subject matter from various well sites.

Enabling operation of a first logging instrument by the first remote well operation control host and operation of a second logging instrument by the second remote well operation control host may be carried out by using the distributed remote cluster to distribute control capability for a particular instrument to a particular remote well operation control host, by transmitting well logging data from the instruments to the particular remote well operation control host using the distributed remote cluster, and so on.

Although FIG. 5D depicts all data traffic from both ends passing thru a data Center or Cloud type of infrastructure, any possible combination of direct connections to the local wellsite systems, remote systems, and data centers or cloud-based implementations may be employed.

Figure 6:
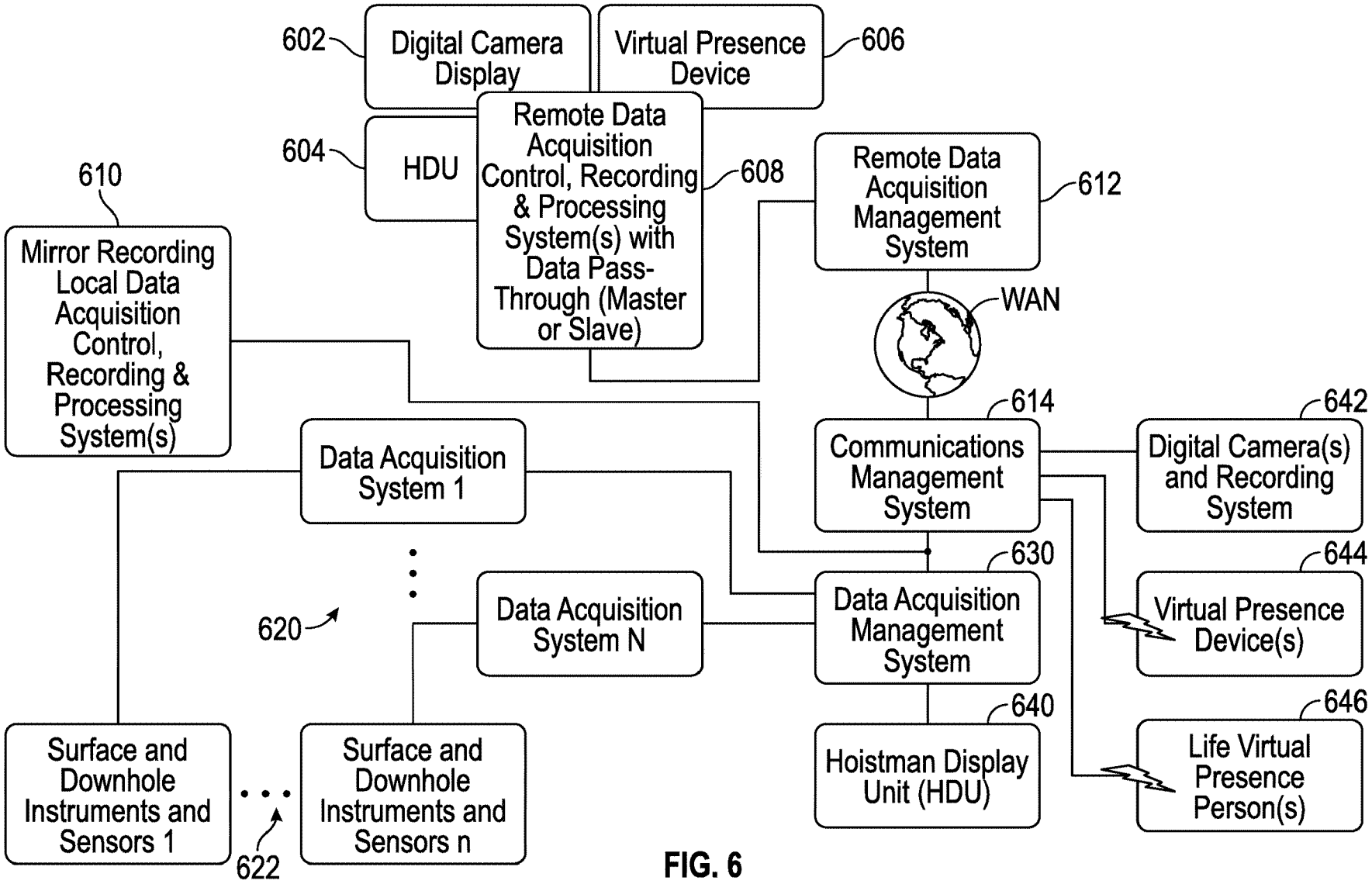
FIG. 6 illustrates another system for remote well logging in accordance with embodiments of the present disclosure.

FIG. 6 illustrates another system for remote well logging in accordance with embodiments of the present disclosure. Surface and downhole instruments and sensors 1 . . . n 622 provide data to data acquisition systems 1 . . . N 620 tailored to interface with corresponding particular tools and data. Data acquisition management system 630 stores data with local system 610 and provides for mirroring the data through communications management system 614 to remote data acquisition management system 612 which stores data to its own local storage and processing system on a network local to the remote data acquisition management system 612. Data acquisition management system 630 also interfaces with hoist device display unit 640.

System 600 further includes enhanced functionality implemented through specialty components. System 600 is configured to use a digital recording system 642 including a digital video camera and associated microphone to transmit with communications management system 614 a virtual presence feed during a logging operation using a Wide Area Network (WAN). The virtual presence feed may include, for example, video information, audio information, gps information, and the like associated with a logging site supervisor from the logging site to at least one of the corresponding remote well logging data acquisition management systems 612. The digital recording system 642 may be incorporated as part of a virtual presence device 644. In some instances, the virtual presence device may be implemented as a personal presence device wearable by the logging site supervisor or other personnel (virtual presence persons 646) or otherwise portable or perspective dependent.

The remote data acquisition management system and/or the remote data acquisition control, recording and processing system may use the virtual presence feed to construct a representation of a virtual presence perspective (e.g., similar to a virtual tour) of the position of the logging site supervisor at the logging site, and present the representation to a remote well operating engineer at the at least one of the corresponding remote well logging data acquisition management systems. In this way, the remote well operating engineer may be able to virtually "stand in the shoes" of the logging site supervisor at the well site. The ability to faithfully recreate visual and auditory cues present at the well site to the remote well operating engineer allows the remote engineer to make faster and more accurate operations decisions based on experience in legacy operations on site.

System 600 may also, during the logging operation, use the Wide Area Network (WAN) to transmit audio instruction data and auxiliary data from the remote well logging data acquisition management system 612 to the logging site. The communications management system 614 (or alternatively, the data acquisition management system 630) may render the audio instruction data as audio instructions via a personal communication system of the logging site supervisor, and render the auxiliary data on a graphic interface of the personal communication system of the logging site supervisor. In this way, the personnel at the well site may be used as a virtual extension of the remote well operating engineer. The remote well operating engineer may make use of the sensory and motion ability of the local personnel through live audio visual contact in order to execute key manual tasks remotely. The audio instruction data may be streamed audio from the well operation engineer or standardized instructions, such as, for example, instructions related to alert conditions or emergencies. Auxiliary data may include step-by-step instructions, excerpts from manuals, maps, simulated control interfaces including guidance indicia, speech-to-text transcripts of the audio, and so on. The simulated control interface may show added text, flags, coloration, or blinking lights to indicate which part of the interface should be interacted with. Auxiliary data may also be overlain on a video feed to provide guidance in a virtual three-dimensional space.

Figure 7B:
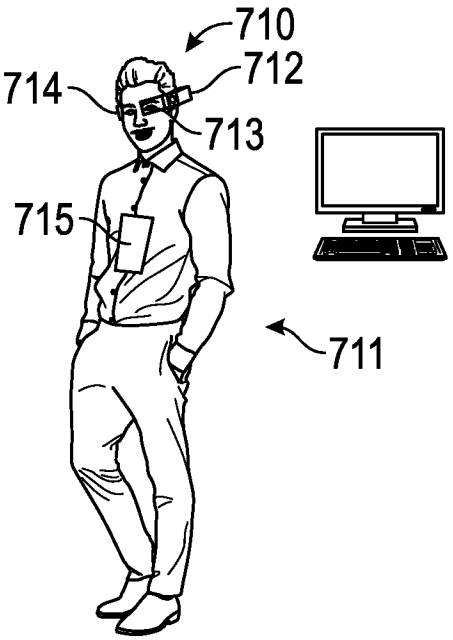
FIGS. 7A-7C illustrate a virtual presence system for incorporation in system embodiments in accordance with the present disclosure.
Figure 7A:
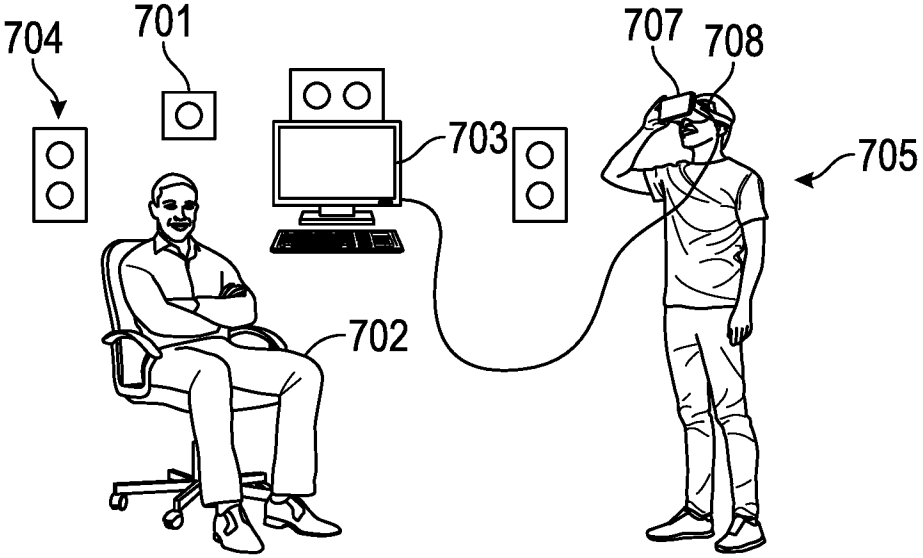
Figure 7C:
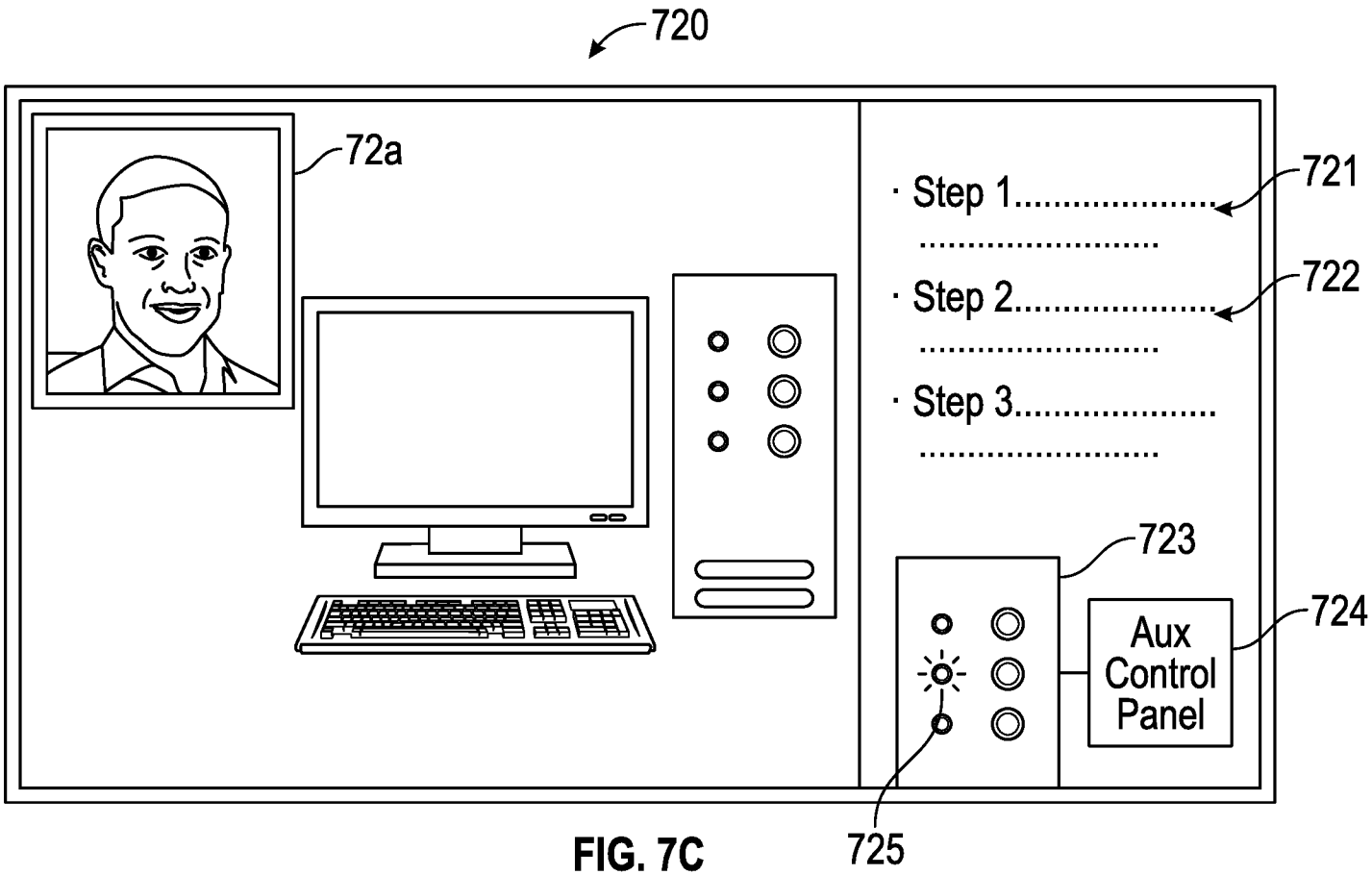

FIGS. 7A-7C illustrate a virtual presence system for incorporation in system embodiments in accordance with the present disclosure. FIG. 7A illustrates virtual present system components in use at a remote data acquisition management system. The system includes a digital webcam focusing on a first well logging operator 702, who can view video and information from a logging site supervisor (see FIG. 7B, 711) on a display 703, and hear audio on surround speaker system 704. A second well logging operator 705 wears a virtual reality visor 707 and headphones rendering the representation of a virtual presence perspective of the position of the logging site supervisor at the logging site.

FIG. 7B illustrates a personal communication system of the logging site supervisor. The personal communication system 710 includes a heads-up display 713, an eye-level camera 712 corresponding to the field of vision of the logging site supervisor 711, and headphones 714. The personal communication system 710 also includes a wearable microphone 715 which may be attached to a lanyard or shirt.

FIG. 7C illustrates a view of the logging site supervisor 711 on the heads-up display 713 of the personal communication system 710. The heads-up display 720 renders graphical elements on a live video presented on a view screen or on live view through a transparent lens. The graphical elements include an inset video feed 729 of first well logging operator 702, and auxillary data in the form of virtual panel overlay 721, which includes a list of steps 722 and a simulated control interface 723 including guidance indicia in the form of label 724 and blinking light overlay 725 indicating the physical button to be pressed.

Audiovisual data and graphical modification of video feeds may be conventionally conducted. See for example, U.S. Pat. No. 9,569,097 to Ramachandran, U.S. Pat. No. 6,223,206 to Dan et al., and U.S. Pat. No. 5,689,641 to Ludwig et al, each incorporated herein by reference.

Techniques for obtaining EM propagation measurements (e.g., relative phase and attenuation) are well known in the art. See for example, U.S. patent application Ser. No. 13/991,029 to Dorovsky et al. and U.S. patent application Ser. No. 15/280,815 to Kouchmeshky et al., each incorporated herein by reference.

Acoustic beam reflection may be conventionally processed to detect azimuthal thickness of multiple tubulars (e.g., production tubing, first and second casing, etc.) as well as position, cement thickness, borehole diameter, bond quality, and so on. See, for example, U.S. Pat. No. 7,525,872 to Tang et al., U.S. Pat. No. 7,787,327 to Tang et al., U.S. Pat. No. 8,788,207 to Pei et al., U.S. Pat. No. 8,061,206 to Bolshakov, U.S. Pat. No. 9,103,196 to Zhao et al., and U.S. Pat. No. 6,896,056 to Mendez et al., each commonly owned with the present application and incorporated herein by reference in its entirety.

Methods include generating an electromagnetic (EM) field using an EM transmitter of the logging tool to produce interactions between the electromagnetic field and a volume of interest. Evaluation of the resulting measurements may be carried out in accordance with techniques known to those of skill in the art. See, for example, U.S. Pat. No. 7,403,000 to Barolak et al. and U.S. Pat. No. 7,795,864 to Barolak et al., each incorporated herein by reference in its entirety.

The tool may include a body (e.g., BHA, housing, enclosure, drill string, wireline tool body) having pads extended on extension devices. Two to six pads may be used. The extension devices may be electrically operated, electromechanically operated, mechanically operated or hydraulically operated. With the extension devices fully extended, the pads may engage the wellbore 580 and make measurements indicative of at least one parameter of interest of the earth formation or wellbore infrastructure (e.g., casing). Such devices are well-known in the art. See, for example, U.S. Pat. No. 7,228,903 to Wang et al., hereby incorporated by reference in its entirety.

U.S. Pat. No. 8,055,448 B2 to Mathiszik et al., having the same assignee as the present disclosure and the contents of which are incorporated herein by reference, discloses further improvements in MWD acoustic imaging. A downhole acoustic logging tool is used for generating a guided borehole wave that propagates into the formation as a body wave, reflects from an interface and is converted back into a guided borehole wave. Guided borehole waves resulting from reflection of the body wave are used to image a reflector. U.S. Pat. No. 8,811,114 B2 to Geerits et al., having the same assignee as the present disclosure and the contents of which are incorporated herein by reference, discloses further improvements in MWD acoustic imaging.

The volume of interest may be a plurality of nested conductive tubulars in the borehole, and estimating the property may be carried out by estimating a property corresponding to at least one tubular (and possibly all) of the plurality of nested conductive tubulars. The property corresponding to each conductive tubular may include at least one of: i) location of the tubular; ii) thickness of the tubular; and iii) at least one property of a defect of the tubular; iv) a presence of a completion component outside at least one tubular; and v) a property of a completion component outside at least one tubular.

The term "substantially real-time" as applied to methods of the present disclosure refers to an action performed (e.g., estimation, modeling, and so on) while the sensor is still downhole, after the generation of the information and prior to movement of the sensor an appreciable distance within the context of evaluating the borehole or formation at an associated resolution, such as, for example, a distance of 50 meters, 25 meters, 10 meters, 5 meters, 1 meter, 0.5 meters, 10 centimeters, 1 centimeter, or less; and may be defined as estimation of the parameter of interest or production of the current iteration of a model within 15 minutes of generating the information, within 10 minutes of generation, within 5 minutes of generation, within 3 minutes of generation, within 2 minutes of generation, within 1 minute of generation, or less.

Methods may include conducting further operations in dependence upon the property. The further operations may include at least one of: i) geosteering; ii) drilling additional wellbores in the formation; iii) performing additional measurements on the formation; iv) estimating additional parameters of the formation; v) installing equipment in the wellbore; vi) repairing infrastructure; vii) optimizing present or future development in the formation or in a similar formation; viii) optimizing present or future exploration in the formation or in a similar formation; and ix) producing one or more hydrocarbons from the formation.

Aspects of the present disclosure include systems and methods for formation evaluation, such as performing well logging in a borehole intersecting an earth formation, as well as casing integrity inspection. "Well logging," as used herein refers to the acquisition of information from a downhole tool located in a borehole, whether the borehole is cased or open, during or after the formation of the borehole. The information may include parameters of interest of the formation, the borehole, infrastructure installed in the formation (e.g., casing, production tubing, etc.), downhole fluids in one of these, or combinations of the same. Drilling systems in accordance with aspects of the present disclosure may have a plurality of "logging-while-drilling" ('LWD') or "measurement-while-drilling" ('MWD') instruments as part of a bottomhole assembly.

Embodiments may include, during a logging operation, using a Wide Area Network (WAN) to transmit raw logging data from the logging site to a receiving node at at least one of: i) the first instrument control station; ii) the second instrument control station; iii) the well operation control host; iv) a data processing system remote from the logging site; v) a display station remote from the logging site; and vi) a data archiving system remote from the logging site. The data may be transmitted in substantially real-time.

While the foregoing disclosure is directed to the one mode embodiments of the disclosure, various modifications will be apparent to those skilled in the art. It is intended that all variations be embraced by the foregoing disclosure.

What is claimed is:

1. A method of remote well logging, the method comprising:

conducting, with a plurality of remote well operation control hosts operating on corresponding remote well logging data acquisition management systems, a well logging operation using a well logging system at a logging site, wherein the well logging system includes a carrier having disposed thereon at least one logging instrument, comprising:

conveying the carrier to intersect a volume of interest relating to the first logging instrument via tool commands from a first of the plurality of remote well operation control hosts;

assigning control of the carrier, upon the device intersecting the volume of interest, from the first of the plurality of remote well operation control hosts to a second of the plurality of remote well operation control hosts different than the first.

2. A method of remote well logging, the method comprising:

conducting, with a plurality of remote well operation control hosts operating on corresponding remote well logging data acquisition management systems, a well control operation using a well control system at a well site, wherein the well control system includes a carrier having disposed thereon a first logging instrument and a second logging instrument, comprising:

operating the first logging instrument responsive to at least one well-logging command from a first remote well operation control host of the plurality; and operating the second logging instrument responsive to at least one well-logging command from a second remote well operation control host of the plurality different than the first; and wherein conducting the well control operation further comprises enabling operation of the first logging instrument by the first remote well operation control host and operation of the second logging instrument by the second remote well operation control host by using a master remote well operation control host, of the plurality of remote well operation control hosts, on a corresponding remote well logging data acquisition management system to distribute control capability for a particular instrument to a particular remote well operation control host.

3. The method of claim 2 further comprising distributing control capability in dependence upon an operational mode.

4. The method of claim 2 further comprising controlling the carrier using at least one well operation control host of the plurality.

5. A method of remote well logging, the method comprising:

conducting, with a plurality of remote well operation control hosts operating on corresponding remote well logging data acquisition management systems, a well control operation using a well control system at a well site, wherein the well control system includes a carrier having disposed thereon a logging instrument, comprising:

operating the carrier responsive to at least one tool command from a first remote well operation control host of the plurality; and operating the logging instrument responsive to at least one well-logging command from a second remote well operation control host of the plurality different than the first; and wherein conducting the well control operation further comprises enabling operation of the carrier by the first remote well operation control host and operation of the logging instrument by the second remote well operation control host by using a master remote well operation control host, of the plurality of remote well operation control hosts, on a corresponding remote well logging data acquisition management system to distribute control capability for the carrier and the logging instrument to particular remote well operation control hosts.

6. The method of claim 2, comprising:

acquiring raw well logging data from the first logging instrument by a local well operation control host on a corresponding well logging data acquisition management system at the well site;

mirroring the acquired raw well logging data to at least one of the plurality of remote well operation control hosts;

issuing a further command from the at least one of the plurality of remote well operation control hosts responsive to the acquired raw well logging data.

7. The method of claim 2, comprising:

acquiring raw well logging data from the second logging instrument by a local well operation control host on a corresponding well logging data acquisition management system at the well site;

mirroring the acquired raw well logging data to at least one of the plurality of remote well operation control hosts;

issuing a further command from the at least one of the plurality of remote well operation control hosts responsive to the acquired raw well logging data.

8. The method of claim 2 further comprising, during the well control operation, using a Wide Area Network (WAN) to transmit logging data generated by the first logging instrument from the logging site to at least one of the plurality of remote well operation control hosts; and using the logging data to control the logging operation with at least one further command from the at least one of the plurality of remote well operation control hosts responsive to the logging data received.

9. The method of claim 2 wherein the carrier comprises at least one of i) a drill string; ii) a wireline; and iii) a downhole tool.

10. The method of claim 2 wherein the well control operation comprises at least one of: i) geosteering; ii) drilling at least one borehole in a formation; iii) performing measurements on a formation; iv) estimating parameters of a formation; v) installing equipment in a borehole; vi) evaluating a formation; vii) optimizing present or future development in a formation or in a similar formation; viii) optimizing present or future exploration in a formation or in a similar formation; ix) producing one or more hydrocarbons from a formation.

11. The method of claim 1, comprising:

acquiring well logging data from the at least one logging instrument by a local well operation control host on a corresponding well logging data acquisition management system at the logging site;

mirroring the acquired well logging data to at least one of the plurality of remote well operation control hosts;

issuing a further command from the at least one of the plurality of remote well operation control hosts responsive to the acquired well logging data.

12. The method of claim 1 further comprising, during the well logging operation, using a Wide Area Network (WAN) to transmit logging data generated by the at least one logging instrument from the logging site to at least one of the plurality of remote well operation control hosts; and using the logging data to control the logging operation with at least one further command from the at least one of the plurality of remote well operation control hosts responsive to the logging data received.

13. The method of claim 12 further comprising controlling one or more of the at least one logging instrument with the at least one further command.

* * * * *